US008178166B2

(12) United States Patent
Tokimasa et al.

(10) Patent No.: US 8,178,166 B2
(45) Date of Patent: May 15, 2012

(54) APPARATUS AND METHOD FOR APPLYING COATING SOLUTION, DIE AND METHOD FOR ASSEMBLING THEREOF

(75) Inventors: Yasuhiko Tokimasa, Kanagawa (JP); Yoshinobu Katagiri, Kanagawa (JP); Akio Tsuji, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 778 days.

(21) Appl. No.: 11/544,618

(22) Filed: Oct. 10, 2006

(65) Prior Publication Data

US 2007/0092655 A1 Apr. 26, 2007

Related U.S. Application Data

(63) Continuation-in-part of application No. 10/336,768, filed on Jan. 6, 2003, now abandoned.

(30) Foreign Application Priority Data

| | | |
|---|---|---|
| Jan. 9, 2002 | (JP) | 2002-002822 |
| Jan. 23, 2002 | (JP) | 2002-014772 |
| Mar. 13, 2002 | (JP) | 2002-068062 |
| Mar. 22, 2002 | (JP) | 2002-081699 |

(51) Int. Cl.
*B05D 3/12* (2006.01)

(52) U.S. Cl. ..... 427/356; 118/300; 118/410; 118/411; 118/419; 118/420; 427/294; 427/350; 427/402

(58) Field of Classification Search ..... 427/356, 427/294, 350, 402; 118/410, 411, 419, 420
See application file for complete search history.

(56) References Cited

U.S. PATENT DOCUMENTS

| | | | | |
|---|---|---|---|---|
| 4,445,458 | A * | 5/1984 | O'Brien | 118/410 |
| 5,119,757 | A * | 6/1992 | Chino et al. | 118/410 |
| 5,411,589 | A * | 5/1995 | Yoshida et al. | 118/688 |
| 5,522,931 | A * | 6/1996 | Iwashita et al. | 118/410 |
| 5,639,305 | A * | 6/1997 | Brown et al. | 118/410 |
| 5,728,430 | A * | 3/1998 | Sartor et al. | 427/356 |
| 6,652,653 | B2 | 11/2003 | Kukubo et al. | |
| 2003/0127048 | A1 * | 7/2003 | Kokubo et al. | 118/410 |

FOREIGN PATENT DOCUMENTS

| | | |
|---|---|---|
| EP | 0 552 653 | 7/1993 |
| JP | 05-329432 | 12/1993 |
| JP | 2001-170542 | 6/2001 |
| WO | WO 95/29764 | 11/1995 |
| WO | WO 96/08319 | 3/1996 |

OTHER PUBLICATIONS

Carvalho, Marcio et al., "Low-Flow Limit in Slot Coating: Theory and Experiments," AIChE Journal, vol. 46, No. 10, pp. 1907-1917 (Oct. 2000).*

* cited by examiner

*Primary Examiner* — Michael Cleveland
*Assistant Examiner* — Alexander Weddle
(74) *Attorney, Agent, or Firm* — Young & Thompson

(57) ABSTRACT

A die of a coating apparatus for applying a coating solution includes down- and upstream blocks in a feeding direction of a web, which respectively have a first lip and a second lip. A lip land of the first lip is shorter than a lip land of the second lip in the feeding direction so as to satisfy a predetermined condition. In assembling the coating apparatus, bottoms of down- and upstream blocks are fixed to a fixer with bolts. Between the fixer and the downstream block, a plate member is provided such that the first lip land protrudes from the second lip land.

15 Claims, 17 Drawing Sheets

APPARATUS AND METHOD FOR APPLYING COATING SOLUTION, DIE AND METHOD FOR ASSEMBLING THEREOF

BACKGROUND OF THE INVENTION

1. Field of the Invention

The present invention relates to a coating apparatus and a method of applying a coating solution on a web with a die, more especially a coating apparatus and a method for forming a multi-layer or mono-layer film by applying on a supporter (hereinafter a web), such as a polymer film, paper, metallic foil and the like, a coating solution of photosensitive emulsifier, magnetic material solution, solution for providing anti-reflectivity and glare shielding ability, solution for providing visual field enlarging effect, pigment solution for color filter, surface protective solution and the like.

2. Description Related to the Prior Art

A multi-layer film is produced by forming a coating when a coating solution is applied on a web by a coating apparatus with a die such as a slot die. Recently, it is required that a thickness of a wet coating on the web is less than 20 μm, in order that the coating film has such effects as is previously expected. The thickness and conditions of the wet coating on the web are strictly determined. Accordingly the coating solution must be applied with high accuracy.

However, when in applying the coating solution on the web, several outer conditions make the thickness of the wet coating on the web uneven, which causes stripes and non-uniformity in the coating. The stripes and the non-uniformity become more remarkable when the thickness of the wet coating becomes smaller. Accordingly, Japanese Patent Laid-Open Publication No. 9-511682 discloses a technology of sharpening of lips of a slot die. Concretely, each lip land or lip end has an arc-shaped form whose radius should not be more than 10 μm. However, a small error in producing processes has a large influence on forming the coating, in this case.

The radius of the lip land is usually determined as a width (herein after land width) of a flat portion which is formed in a feeding direction of the web and usually called a lip land. When the radius of the lip land is shorter than 30 μm, the lip end or the lip land are easily broken, which causes to generate stripes. Therefore it is hard to continuously carry out the coating. Further as shown in FIG. 19, a coating solution 216 discharged from a slit 206 of a die 200 covers lip lands 201*a*, 201*b* of down- and upstream lips 202, 203. When the coating solution 216 widens on the lip land 201*a* of the downstream lip 202, the coating on a web 212 has an inadequate shape, and therefore the film products have stripes on a coating surface. It is hard to adjust a position of wet line, an edge of the coating solution 216, on the downstream lip 203.

It is already known that there are several reasons for generating the unevenness, which are, for example, the change of feeding velocity of the web, the cyclic change of distance between a back-up roller for feeding the web and the lip land of the downstream lip. The variation of the distance between the buck-up roller and the lip land is caused by decentering in the back-up roller. The cause of the decentering of the back-up roller is that the core of the back-up roller does not protrude, or that a cross-section of the back-up roller does not have a strictly circular shape. Note that the unevenness in the amount of discharging the coating solution is caused by the pump feeding the coating solution in pulse movement.

There are other causes of the unevenness, for example, in variable positional relation between a vacuum chamber and the coating apparatus or between a vacuum chamber and the web while the coating apparatus and the web are confronted to the vacuum chamber. Note that the vacuum chamber is provided near to a bead formed by the coating solution exactly before applied on the web, so as to keep an adequate situation for preventing an unstable form of the bead. In this case, the variation of the positional relation prevents the uniform aspirate of the air from the vacuum chamber. Accordingly the bead often vibrates to cause the unevenness. In order to apply the coating solution on the web adequately, the above situations therefor must be improved. However, there are large problems about cost and techniques for the improvement. Note that an air pressure is set to a lower level in the vacuum chamber than usually.

The applicant proposes in the Japanese Patent Application No. 2001-368113a method to prevent the generation of the unevenness. In order to form the bead uniformly, a lip land of the upstream lip is bend at less than 100°, and a position of an upper meniscus of the bead is fixed at an upstream edge of a lip land of an upstream lip. Further, the change of the conditions of the outer in applying the coating solution has a smaller influence on the shape of the bead. Accordingly the unevenness in the coating is effectively prevented. However, as the situation of applying the coating solution becomes worse in the above method, the bead is often split, which causes the stripe in the coating.

The bead must be formed uniformly by setting the pressure decrease as small as possible. The formation of the coating on the web has a large influence on the quality of the film product. When in applying the coating solution on the web, the unstable situation of the edges in the bead causes the deformation of the coating. When the pressure decrease is made too efficiently, the wet coating on the web widens more than the expected one to cause the unevenness of the wet coating on the web. Especially, when the amount of the wet coating becomes smaller in the both sides, then the usable area for the film product becomes smaller. Furthermore, part of the bead, especially edges thereof, in which the amount of the coating solution decreases, brakes easily.

In Japanese Patent Publication No. 2001-170542, a regulation member is provided with the coating apparatus for regulating the width of the coating solution. The forward end of the regulation member is positioned slightly forwards of the lip land so as to form the bead uniformly. However, effects of the coating apparatus in this publication become smaller when in using the coating solutions having high viscosity or when in forming thick layers.

When the gap between the web and the lip in the downstream side (hereinafter downstream lip) of the die is smaller, the thinner coating is formed. However, the upstream lip has none of such conditions. Therefore, the gap between the upstream lip and the web may become larger. Considering these conditions of the down- and upstream lips, two conditions are to be satisfied. First, the gap between the upstream lip and the web becomes larger to prevent the pressure loss in the upstream side of the bead. Secondly, the gap between the downstream lip and the web is smaller to make the coating thinner. Accordingly, an overbite formation of the die is proposed.

The die of the overbite formation is used for forming the coating in high accuracy. In such die, the upstream lip has larger distance to the web than the downstream lip. In Japanese Patent Laid-Open Publication No. 9-511682, the position of the bead is fixed to a downstream edge of the upstream lip to form the bead uniformly. Further, the applicant proposed in the Japanese Patent Application No. 2002-014772 a coating apparatus including the die in the overbite formation to form the coating in high accuracy. Note that a difference between the gap from the web to the upstream lip and that from the web to the downstream lip is determined as an overbite length.

When the overbite length is too small, the effect of the overbite formation is not large. When the overbite length is too large, a slight variation of pressure decrease has influence on the formation of the bead, and the bead is not formed uniformly, and split furthermore. Further, when the difference between the gap from the downstream lip to the web and the gap from the upstream lip to the web is too small, the bead is hardly fixed to the upstream lip with small value of the decreased pressure. When the difference is too large, the bead is fixed too much even with the small value of the decreased pressure. Accordingly, the overbite length is to be adjusted to an adequate value, which is determined in accordance with the following conditions, such as the kinds and the viscosity of the coating solution, the coating velocity of the coating solution, the thickness of the wet coating, and the like. However, high cost and high techniques are required for forming the lip of the overbite formation.

There is a type of the die in which an upstream end block has the upstream lip and a downstream end block has the downstream lip. The upstream and downstream end blocks are attached to the upstream and downstream lip bodies, respectively. In this type of the die, when one of the up- and downstream end blocks is broken or disassembled, it is changed. However, it is hard to have the same overbite length thereby.

Further, there is a method for measuring the overbite length. In this method, the gap from the protruding lip to the web is measured in high accuracy, while the gap from the other retracted lip to the web is often measured with a large error, or cannot be measured. The gap from the back-up roller to the web or the lip may be measured with a gage or in a method proposed in the Japanese Patent 2002-047078 by the applicant of the present invention.

SUMMARY OF THE INVENTION

An object of the present invention is to provide an apparatus and a method for applying a coating solution on a web, in which neither unevenness nor stripe is generated in a coating.

Another object of the present invention is to provide an apparatus and a method for applying a coating solution on a web, in which a bead of the coating solution is neither split nor damaged.

Still another object of the present invention is to provide an apparatus and a method for applying a coating solution on a web, in which a bead is uniformly formed.

Still another object of the present invention is to provide a die and a method for assembling thereof, with which with which neither unevenness nor stripe is not generated in a coating.

Still another object of the present invention is to provide a die and a method for assembling thereof, in which the coating solution does not widen on a lip land of the downstream lip.

In order to achieve the object and the other object, in an apparatus and a method for applying a coating solution on a web of the present invention, the coating solution is discharged from a slot of a die to the web which is supported with a back-up roller. In the die, the slot is formed between a first lip and a second lip. The first lip is disposed downstream from the second lip in a feeding direction of the web. An end of the first lip is provided with a first lip land which is flat and confronted to the web. The first lip land satisfies a condition $30\ \mu m \leqq L1 \leqq 100\ \mu m$, while $L_1$ is a length of the first lip land in the feeding direction.

Further, in an apparatus and a method for applying the coating solution on a web of the present invention, a regulation member is provided for regulating a coating width of the coating solution. In the die having the regulation member a first gap between the first lip and the web is smaller than a second gap between the second lip and the web. A third gap between the regulation member and the web is set so as to be more than the first gap and less than the second gap.

Further, the slot may be formed between a first block and a second block which are contacted to each other, and front ends of them have the first lip land and the second lip land. There is a step between the first lip land and the second lip land. A difference between the first gap $G_1$ and the second gap $G_2$ is a height of the step. The height is 30 μm to 120 μm.

In a method for assembling the die for applying the coating solution on the web, the first block and the second block of the die are separate. Backs of the first and second blocks are mounted on a standard surface of a base to keep a step between the first and second lip lands. Thereafter the first and second blocks are integrally combined with each other.

It is preferable that a plate member having a thickness T is sandwiched between the back of the first block and the standard surface of the base. Further, the backs of the first and second blocks are fixed or temporary fixed to the base before integrally combining the first and the second blocks.

According to the invention, the first lip land of the first lip has the length $L_1$ in a feeding direction on the web while the length $L_1$ satisfies a condition $30\ \mu m \leqq L1 \leqq 100\ \mu m$. Accordingly, the unevenness is not generated when the coating solution is applied on the web. Further as the die of the apparatus of the present invention has the step between the first lip land and the second lip land, the unevenness and stripes are not generated in the coating on the web.

When in assembling the die of the apparatus for applying the coating solution, the backs of the separate first and second blocks are mounted on a standard surface of the base. Accordingly, the coating solution does not widen on the first lip land of the first lip which is disposed downstream from the second lip in the feeding direction of the web.

BRIEF DESCRIPTION OF THE DRAWINGS

The above objects and advantages of the present invention will become easily understood by one of ordinary skill in the art when the following detailed description would be read in connection with the accompanying drawings.

PREFERRED EMBODIMENTS OF THE INVENTION

Figure 1A:
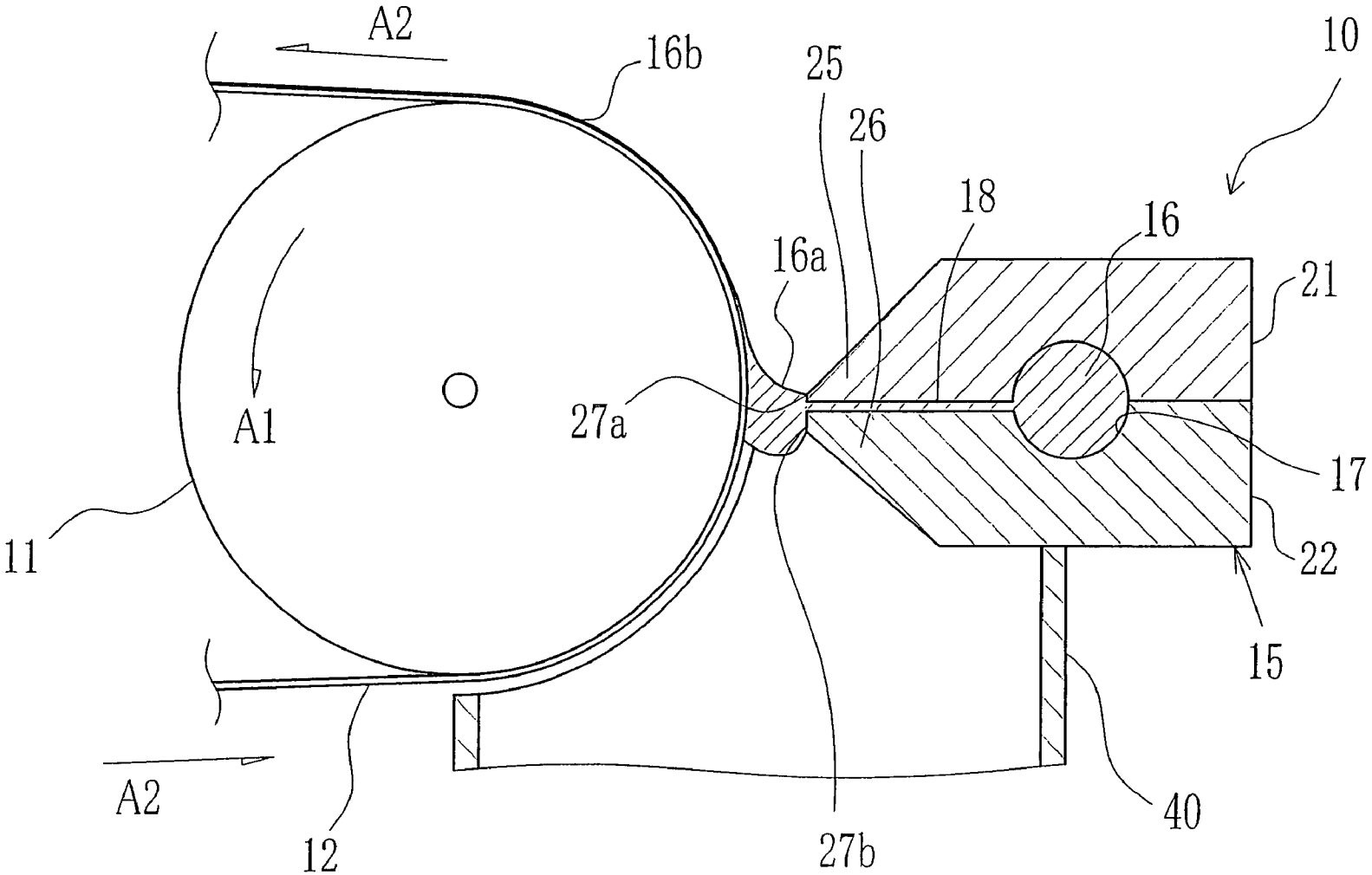
FIG. 1A is a schematic diagram of a coating apparatus of the present invention.

In FIG. 1A, a coating apparatus 10 has a back-up roller 11, a die 15 and a vacuum chamber 40. A web 12 is supported with the buck-up roller 11 and confronted to a die 12. When the back-up roller 11 rotates in a direction A1, the web 12 is fed in a direction A2. The die 15 is constructed of a downstream block 21 and an upstream block 22. The downstream block 21 has a first lip 25 and a first lip land 27*a*, and the upstream block has a second lip 26 and a second lip land 27*b*. The die 15 has a pocket 17 and a slot 18 between the downstream block 21 and the upstream block 22. A coating solution 16 is supplied from a side or a middle of a rear face of the die 15 into the pocket 17, passes through the slot 18, and is discharged outside the die 15. Thereby the vacuum chamber 40 sucks air around the coating solution 16 discharged from the die 15, to form a bead 16*a* with an adequate shape between the die 15 and the web 12. Thus the coating solution 16 is applied on the web 12 to form a coating 16*b*. Note that the vacuum chamber 40 is positioned not so as to contact to the bead 16*a*. Further in the vacuum chamber 40, the air is sucked or aspirated to a predetermined pressure lower that the normal pressure.

The pocket 17 has a cylindrical shape extending in a widthwise direction of the die 15, which is perpendicular to the feeding direction A2, to an opening (not shown) on a side of the die 15. A stopper is fitted in the opening to form a space for storing the coating solution 16. A length of the pocket 17 in the widthwise direction of the die 15 is usually the same as or longer than a width of applying the coating solution 16 on the web 16.

Figure 1B:
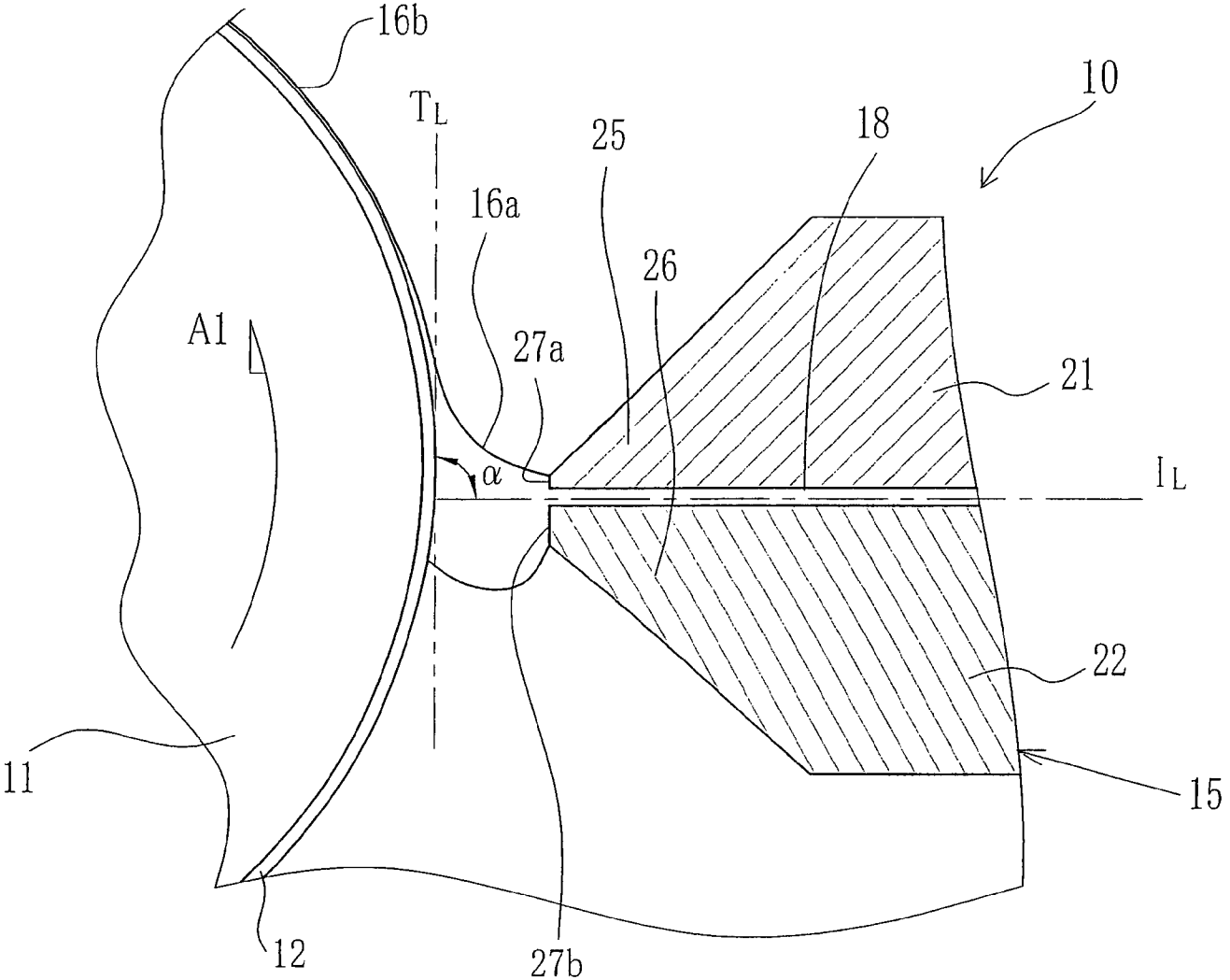
FIG. 1B is an explanatory view illustrating a positional relation between the coating apparatus and the web.

The slot 18 has the length the same as the pocket 17 in the widthwise direction of the die 15. A regulation plate 52 (see, FIG. 7) is provided in the slot 18 between the first and second lip land 27*a*, 27*b* for regulating a width of the coating solution 16 to be applied on the web 12. The regulation plate 52 is operated with an operator 53 (see, FIG. 7). Considering an imaginary line IL extending through the slot 18 as shown in FIG. 1B, the imaginary line IL reaches the web 12 at a point P1. Here the imaginary line IL crosses at an angle $\alpha$ in a downstream side with a tangent line TL to the web 12 that is formed at the point P1. The angle $\alpha$ is 90° in this embodiment. However the angle $\alpha$ may satisfy a condition $30° \leqq \alpha 90°$. Note that the vacuum chamber 40 in FIG. 1A is omitted for easiness in FIG. 1B.

Figure 20:
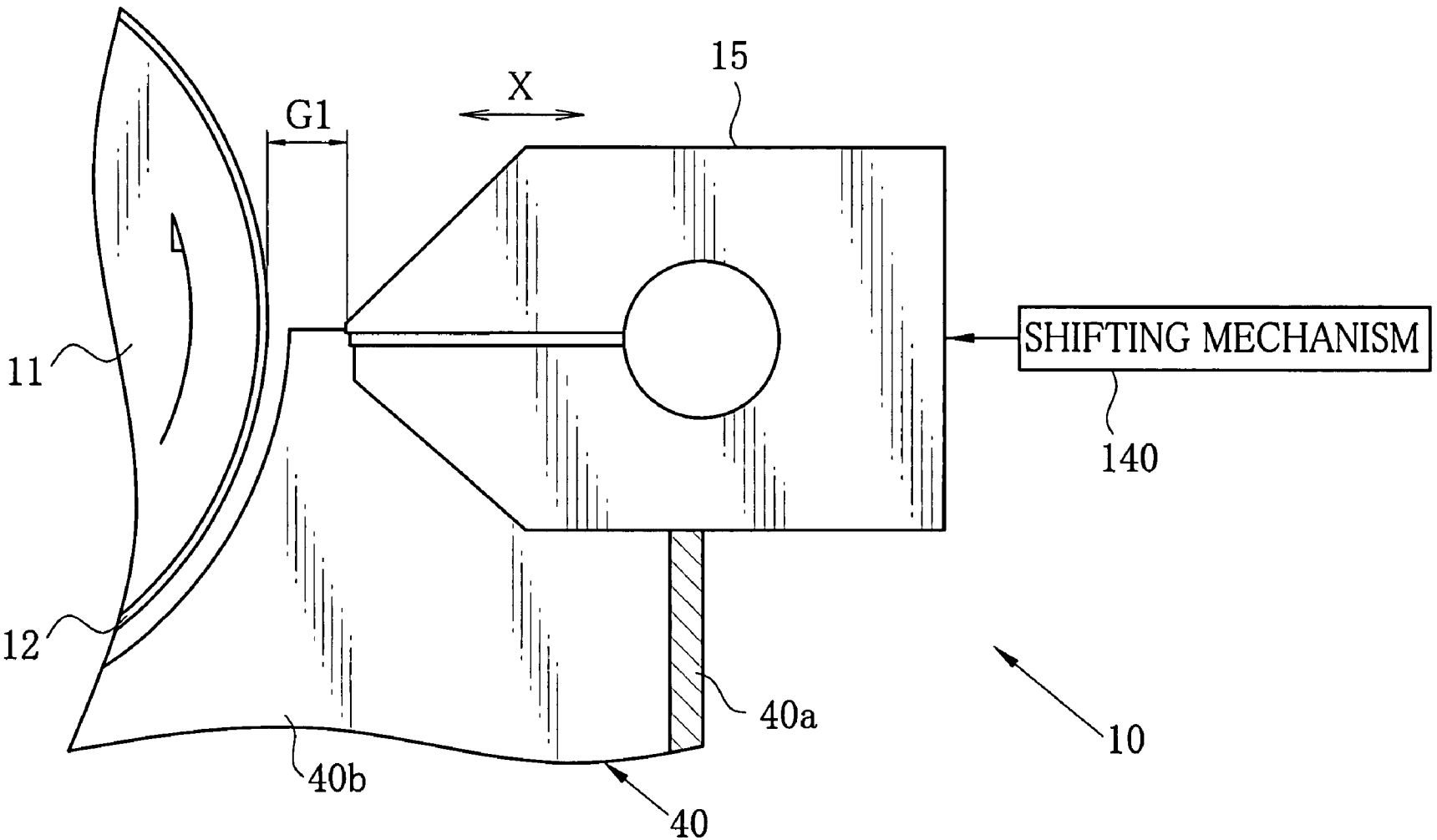
FIG. 20 is a schematic diagram of the die.

As shown in FIG. 20, the die 15 is provided with a shifting mechanism 140 for shifting the die 15 between a coating position for coating and a retreat position where the distance from the back-up roller 11 is larger than the coating position. In this embodiment, the die is movable in a direction shown as an arrow X in FIG. 20. Stoppers (not shown) may be provided at the coating position and the retreat position respectively so as to fix the die 15, or a mechanism for controlling a shifting amount by the shifting mechanism 140 may be provided. In addition, this shifting mechanism 140 can finely adjust a distance $G_1$ between the lip and the web 12 at the coating position in accordance with the setting of the position of the stoppers or the setting of the shifting amount by the shifting mechanism 140. Note that the shifting mechanism 140 may not be provided in the die 15. For example, the shifting mechanism may includes a plate member on which the die 15 is placed and a controller for shifting the plate member to detect and record the disposition at the coating position.

There are several materials for forming the web 12, for example, polyethylene terephthalate (PET), polyethylene-2, 6-naphthalate (PEN), cellulose diacetate (DAC), cellulose triacetate (TAC), cellulose acetate propionate, polyvinyl chloride (PVC), polyvinylidene chloride, polycarbonate (PC), polyimide, polyamide and the like. The web 12 may be also formed of following materials, a paper, or a paper coated or laminated with a coating of a-polyolefine having 2-10 carbons, such as polyethylene, polypropyrene, ethylene butene copolymer and the like. further, there are metal foils, such as aluminum foil, cupper foil, tin foil and the like, and a continuous substrate whose surface is coated with a preliminary layer.

There are several sorts of solvents for preparing the coating solution 16, for example, water, hydrocarbon halides, alcohols, ethers, ketons and the like. One or mixture of them may be used for the solvent.

There are a lot of types of the coating solution 16 used for the present invention, for example, solutions for optical compensation sheet, antireflection film, glare-shielding solution, photosensitive coating solution, magnetic solution, solution for enlarging angle of field of view, surface protection solution, antistatic solution, slip solution, solution of pigment for color filter and the like. However, sorts of the coating solution is not restricted in them.

It is preferable that viscosity $\rho$ and surface tension $\sigma$ of the coating solution 16 respectively satisfy a conditions $0.5 \leqq \rho \leqq 100$ mPa·s and $20 \leqq \sigma \leqq 70$ mN/m. A coating velocity may be less than 100 m/min. The present invention has an especially large effect when the wet coating to be formed on the web is thin, and when the viscosity is very large.

Figure 2:
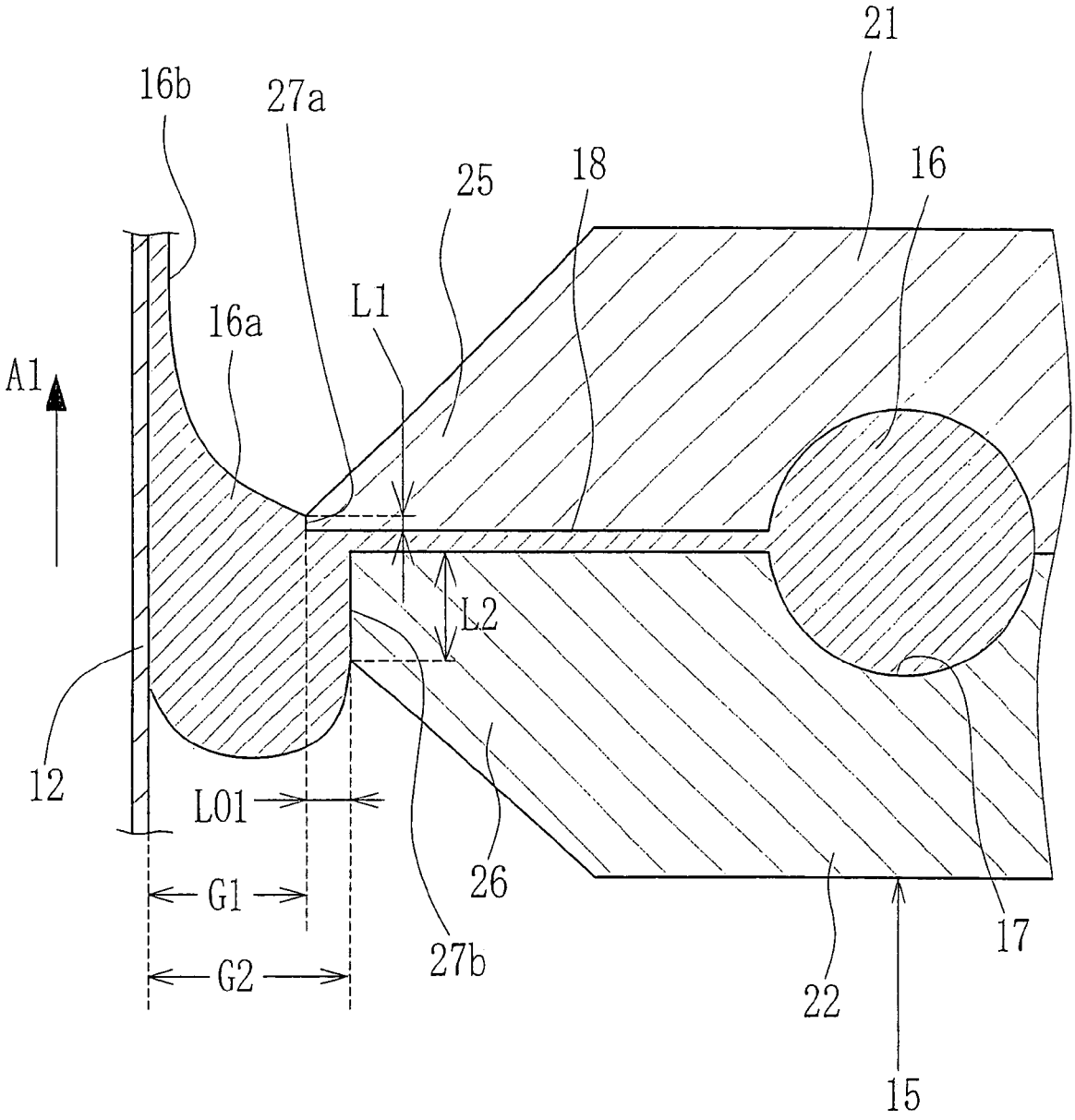
FIG. 2 is a schematic diagram of a die of the coating apparatus in FIG. 1.

In FIG. 2 the vacuum chamber 40 is not illustrated for easiness of this figure. A land length $L_1$ of the first lip land 27*a* is smaller than a land length $L_2$ of the second land lip 27*b*. The length $L_1$ satisfies condition: $30\ \mu m \leqq L1 \leqq 1100\ \mu m$, preferably $30\ \mu m \leqq m \leqq L1 \leqq 180\ \mu m$, especially $30\ \mu m \leqq L \leqq 160\ \mu m$. Under this condition, the coating solution 16 is applied on the web 12 even, and the first lip land 27*a* of the first lip 25 can be formed correctly.

When the land length $L_1$ is less than 30 μm, the first lip land 27*a* or edge of the first lip 25 is often broken, which causes to generate stripes in the coating 16*b*. When the land length $L_1$ is more than 100 μm, the coating solution 16 cannot have an adequate form of the bead 16*a*, which prevents the coating solution from being applied on the web 12.

Note that there is no condition of the land length $L_2$. However, it is usually formed between 500 μm and 1 mm.

Further, the first lip land 27*a* is positioned closer to the web 12 than the second lip land 27*b*, that is, a gap $G_1$ between the web 12 and the first lip land 27*a* of the first lip 25 and is larger than a gap $G_2$ between the web 12 and the second lip land 27*b* of the second lip 26. Note that the gap $G_1$ is also the same as a gap between the web 12 and the die 15 in this embodiment. Although the gap $G_1$ is preferably measured at as many positions as possible in a width direction of the web 12, it is sufficient to measure at equal to or more than 10 and equal to or less than 50 positions for the die 15 whose width is equal to or more than 1 m, which is generally used for manufacturing. If the number of the measurement points is less than 10, it may not be possible to obtain the maximum and the minimum of the gap $G_1$ correctly. Note that feeding of the web 12 is stopped when the gap $G_1$ is measured. Thus the die 15 has an overbite shaped form. Accordingly, the decreased pressure from the normal pressure can be made smaller, and the bead 16*a* can be formed without variation of the adequate shape thereof.

It is preferable that an overbite length $L_{o1}$ or a difference between the gap $G_1$ and the gap $G_2$ satisfies a condition 30 μm≦LO1≦120 μm, particularly 30 μm≦LO1≦100 μm, and especially 30 μm≦LO1≦80 μm.

The shape of the bead 16*a* easily varies in changeable conditions around the bead. In order to form the coating 16*b* with a constant thickness, a variation of the land length $L_1$ at each point in the widthwise direction of the die 15 may be less than 20 μm in the first lip land 27*a*.

Further, strength of the first and second lips 25, 26 and situations of surfaces thereof can be improved when they are formed of hard alloy in which carbide crystal is contained. Thus the surfaces of the first and second lips 25, 26 have a uniform shape, and the abrasion of the surfaces hardly occurs when the coating solution 16 contacts to the surfaces of the first and second lips 25, 26. This improvement is especially effective when in applying the magnetic material solution containing abrasive material. The hard material is, for example, a material produced by binding the metal (such as Cobalt) with crystals of tungsten carbide (WC) having averaged diameter at 5 μm or less. Note that the metal is not restricted in tungsten, and may be other metal, such as titanium, tantalum, niobium and the like.

Further, in order to form the coating 16*b* even, it is necessary to regulate not only the accuracy of the land length $L_1$ at each points in the widthwise direction of the coating 16*b*, but also a straightness of both the back-up roller 11 and the first and second lips 25, 26.

Figure 3:
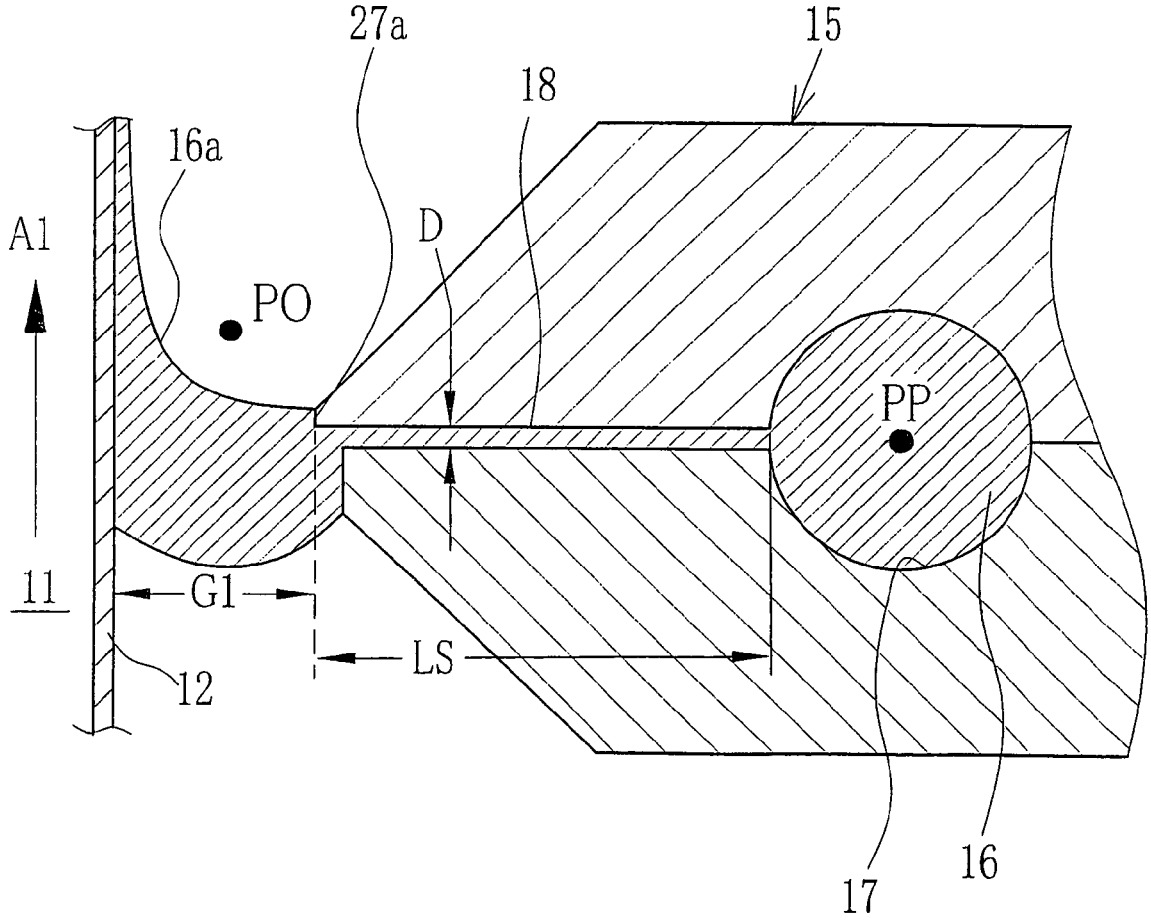
FIG. 3 is an explanatory view of a bead and the die.

In FIG. 3, the straightness is determined in accordance with an upper pressure $P_O$ close to an upper meniscus of the bead 16*a*, that is an air pressure in a downstream side of the feeding direction of the web 12 from the bead 16*a*, a inside pressure $P_P$ in the pocket 17, a land length $L_1$, a length $L_S$ and a distance D of the slot 18, a surface tension σ and a viscosity μ of the coating solution 16, a coating velocity U, and a wet thickness h of the coating 16*b*. A difference $P_O$-$P_P$ between the upper pressure $P_O$ and the inside pressure $P_P$ is formalized as follows:

$$P_O-P_P=1.34\sigma/h\cdot(\mu U/\sigma)^{2/3}+12\mu\cdot U\cdot(L1)\cdot\{(G1)/2-h\}/G1)^3-12\mu\cdot h\cdot U\cdot(LS)/D^3 \quad (1)$$

The straightness is calculated by using the formula (1) when the difference $P_O$-$P_P$ does not vary. In the present invention, even though the gap $G_1$ between the web 12 and the first lip land 27*a* varies, the coating solution 16 flows in the pocket 17 so as to adequately distribute in the widthwise direction of the die 15. Accordingly the difference $P_O$-$P_P$ is kept constant.

First, a difference of h which is calculated in the formula (1) as $P_O$-$P_P$ is constant in the width direction, and a difference between a maximum and a minimum of the gap $G_1$ is obtained such that the difference of h is equal to or less than 2%. The difference $h_{dif}$ of h is defined by a maximum $h_{max}$ of h, a minimum $h_{min}$ of h and an average value $h_{ave}$ of h as follows, $$h_{dif}=(h_{max}-h_{min})h_{ave} \quad (2)$$

Next, in order that the actual variance of the gap $G_1$ becomes equal to or less than the above obtained difference, the die 15 is produced with high accuracy so as to improve the straightness of the lip. Moreover, the die 15 is set to the coating position before starting actual coating, and the gap $G_1$ is measured at equal to or more than 10 and equal to or less than 50 positions in the width direction of the web 12 to obtain a maximum and a minimum of the gap $G_1$. Then adjustments of the parallelism of the die 15 to web 12 and the flexure of the die by using volts and the like are executed such that the measured difference between the maximum and the minimum of the gap $G_1$ becomes equal to or less than the target difference of the gap $G_1$ obtained by the formula (1). In the coating for a usual industrial production, the required variance of the gap $G_1$ is obtained as 5 μm by using the formula (1). This method is effective if the gap $G_1$ is equal to or more than 2×h. In addition, this method has a remarkable effect when the distance D of the slot 18 satisfies a condition 100 μm≦D≦500 μm or the length $L_S$ of the slot 18 satisfies a condition 40 mm≦LS≦100 mm.

The wet thickness h of the coating 16*b* is adjusted by changing an amount of the coating solution 16 discharged from the slot 18 and the rotation speed of the back-up roller 11 so as to satisfy a condition 1 μm≦h≦20 μm. In addition, the die 15 is preferably produced as follows. First, the gap $G_1$ of the die 15 to be used or other die produced by the same producing method is measured at equal to or more than 10 and equal to or less than 50 positions in the width direction of the web 12 so as to grasp the straightness in processing dies. Then, a minimum of the length $L_1$ of the first lip land 27*a* (see FIG. 2) is determined by using the formula (1) such that the measured values of the wet thickness h fall within a range of the predetermined value of h±1% to produce a slot die.

Two examples for determining the accuracy of $G_1$ are described below. Note that each parameter is described in the SI units and $P_O$-$P_P$ may be assumed to be constant. In the first example, the parameters are set as follows:

$L_1=50\times10^{-6}$(m), $h=5$(μm)$=5\times10^{-6}$(m), $G_1=40$(μm)$=40\times10^{-6}$(m), $U=40$(m/min)$=0.667$(m/s), $\sigma=24$(mN/m)$=24\times10^{-3}$(N/m), $\mu=2$(mPas)$=2\times10^{-3}$(Pas), $LS=50$(mm)$=50\times10^{-3}$(m), $D=130$(μm)$=130\times10^{-6}$(m).

When h varies between h±1%, hmax is $5.05\times10^{-6}$ (m) and hmin is $4.95\times10^{-6}$ (m). By substituting these parameters into the formula (1) and using the value of $P_O$—$P_P$ when h is 5 microns, a minimum and maximum of $G_1$ become $36.43\times10^{-6}$ (m) and $44.05\times10^{-6}$ (m) respectively. Therefore, the required accuracy of $G_1$ is 7.32 microns.

In the second example, the parameters are set as follows:

$L_1=80\times10^{-6}$(m), $h=8$(μm)$=8\times10^{-6}$(m), $G_1=50$(μm)$=50\times10^{-6}$(m), $U=80$(m/min)$=1.33$(m/s), $\sigma=21$(mN/m)$=21\times10^{-3}$(N/m), $\mu$=0.9(mPas)=0.9×10$^{-3}$(Pas), $LS$=50(mm)=50×10$^{-3}$(m), $D$=200(μm)=200×10$^{-6}$(m).

When h varies between h±1%, hmax is 8.08×10$^{-6}$ (m) and hmin is 7.92×10$^{-6}$ (m). By substituting these parameters into the formula (1) and using the value of $P_O$-$P_P$ when h is 8 microns, a minimum and maximum of $G_1$ become 47.39×10$^{-6}$ (m) and 52.90×10$^{-6}$ (m) respectively. Therefore, the required accuracy of $G_1$ is 5.51 microns. Taking the other factors causing the change in the thickness of the coating 16*b* into consideration, the actual accuracy of $G_1$ needs to be equal to or less than 5 microns.

Figure 4:
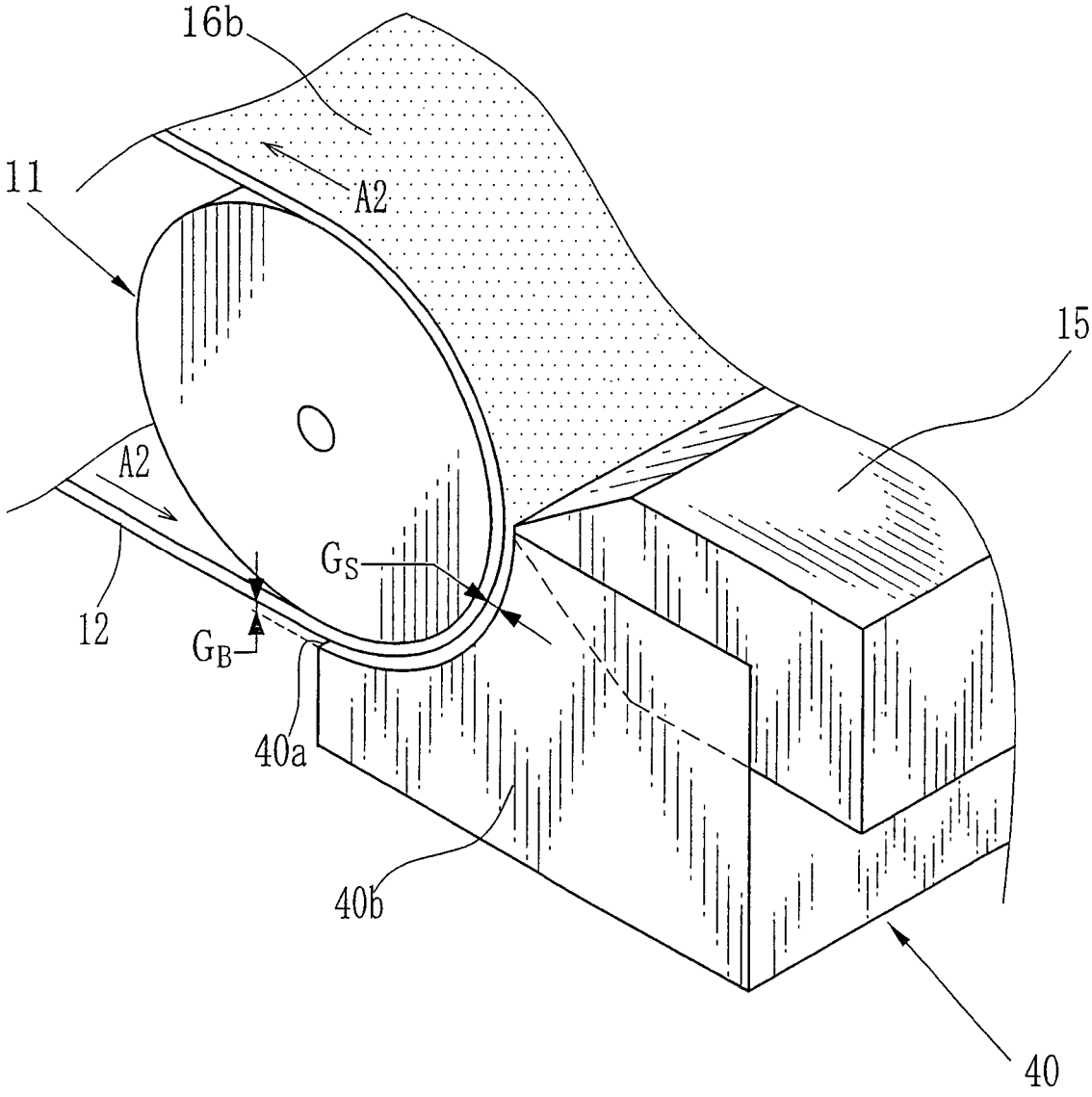
FIG. 4 is a perspective view of the coating apparatus and the vacuum chamber.

As shown in FIG. 4, the vacuum chamber 40 includes a back plate 40*a* and side plates 40*b*. In the vacuum chamber 40, an opening facing the web 12 is formed, and the vacuum chamber 40 divides a decompression area. The back plate 40*a* is disposed with extending in the width direction of the web 12 and standing against a feeding path of the web, and divides an upstream side of the decompression area in the feeding direction of the web 12. The side plates 40*b* have cutouts substantially in an arc almost along the periphery of the back-up roller 11 and the feeding path of the web 12, and divide the decompression area at the both ends of the web 12. There are a gap $G_B$ between the web 12 and the back plate 40*a* and a gap $G_s$ between the web 12 and the side plate 40*b*. When the side plate 40*b* is disposed outside the both ends of the web 12, the gap $G_S$ is assumed to be a distance between the back-up roller 11 and the side plate 40*b*.

Figure 5:
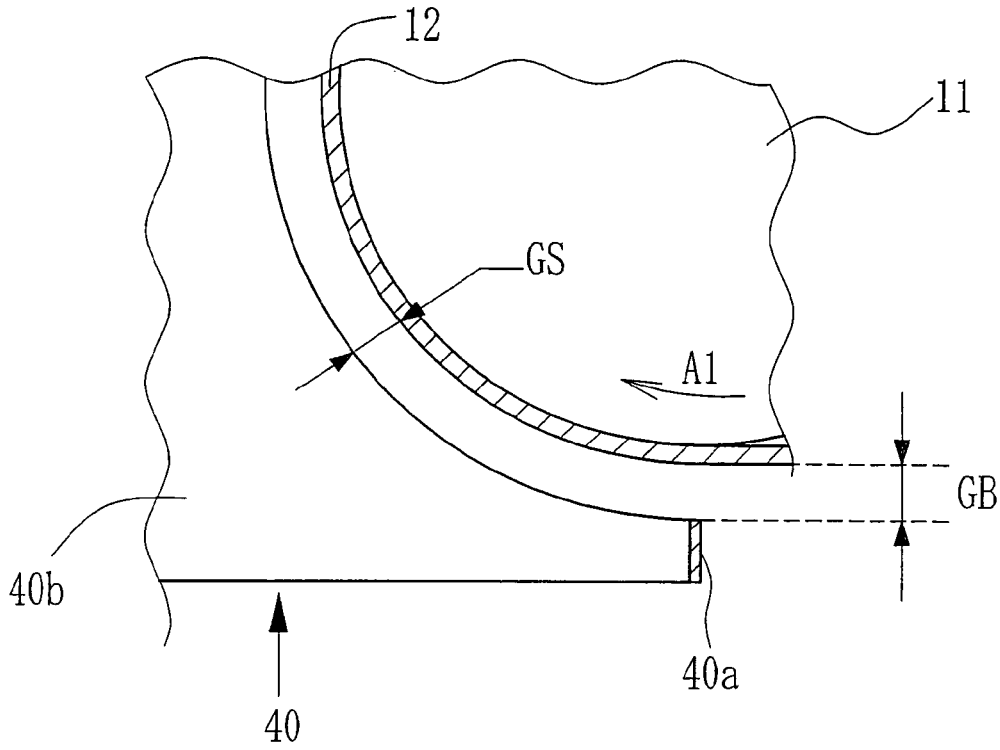
FIG. 5 is a sectional view of the web and a vacuum chamber of the coating apparatus.

In FIG. 5 the back up plate 40*a* is formed with the side plate 40*b*. The gap $G_B$ is determined between the web 12 and the top of the back plate 40*a* of the vacuum chamber 40, as the vacuum chamber is disposed below the web 12 and the die 13 in this figure. Note that air flow near the bead 16*a* caused by feeding the web 12 can be restrained by setting a distance between the back plate 40*a* and the bead 16*a* more than a predetermined value. As shown in FIG. 4, the position of the back plate 40*a* is preferably on a vertical line passing through the center of the back-up roller 11, so as to facilitate setting, measuring and finely adjusting the gap G.

Figure 6:
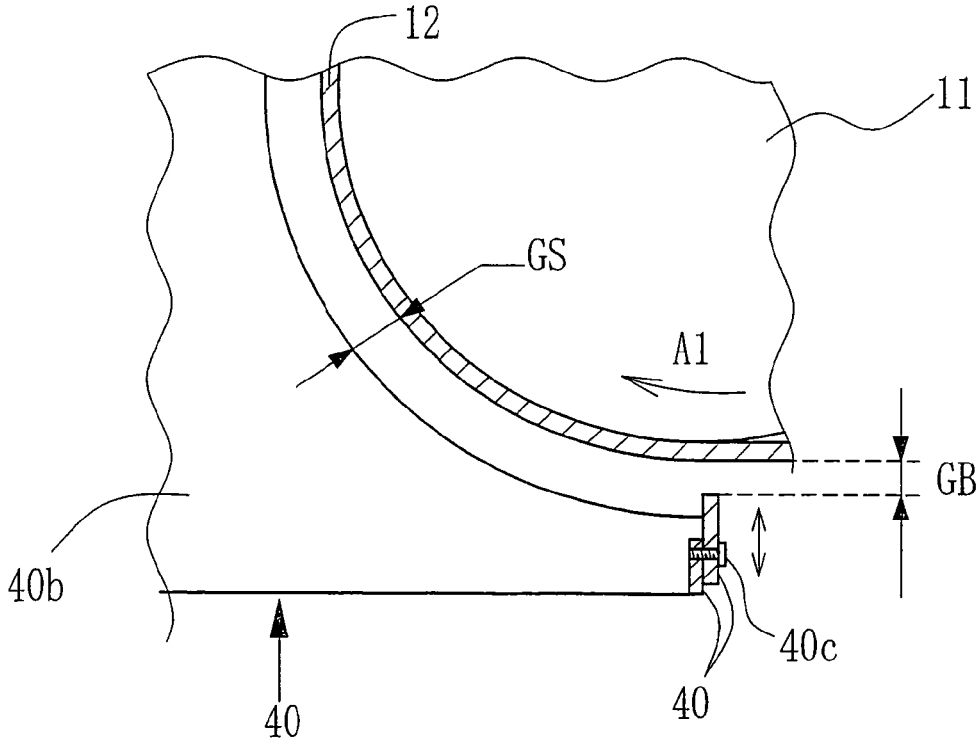
FIG. 6 is a sectional view of the web and a vacuum chamber of another embodiment of the coating apparatus.

As shown in FIG. 6, the back plate 40*a* and the side plate 40*b* may be fixed to the vacuum chamber 40 with screws 40*c*. The respective positions of the back plate 40*a* and the side plates 40*b* can be finely adjusted with keeping the screws 40*c* loose. Thereby, because the positions of the back plate 40*a* and the side plates 40*b* can be independently adjusted with keeping the vacuum chamber 40 disposed in the coating position, the gap $G_B$ and $G_S$ can be adjusted properly. It is preferable that the gap $G_B$ between the web 12 and the back plate 40*a* is larger than the gap $G_1$ between the web 12 and the die 15 or the first lip land 27*a* of the first lip 25. In this case, the value of the decreased pressure around the bead is regulated enough to form the bead 16*a* with the adequate shape, even thought the decentering of the backup roller 11 causes the variation of the value of the pressure decreasing degree. For example, when the gap $G_1$ between the web 12 and the die 15 is 30 μm-100 μm, it is preferable that the gap $G_B$ between the web 12 and the back plate 40*a* is 100-500 μm.

Figure 7:
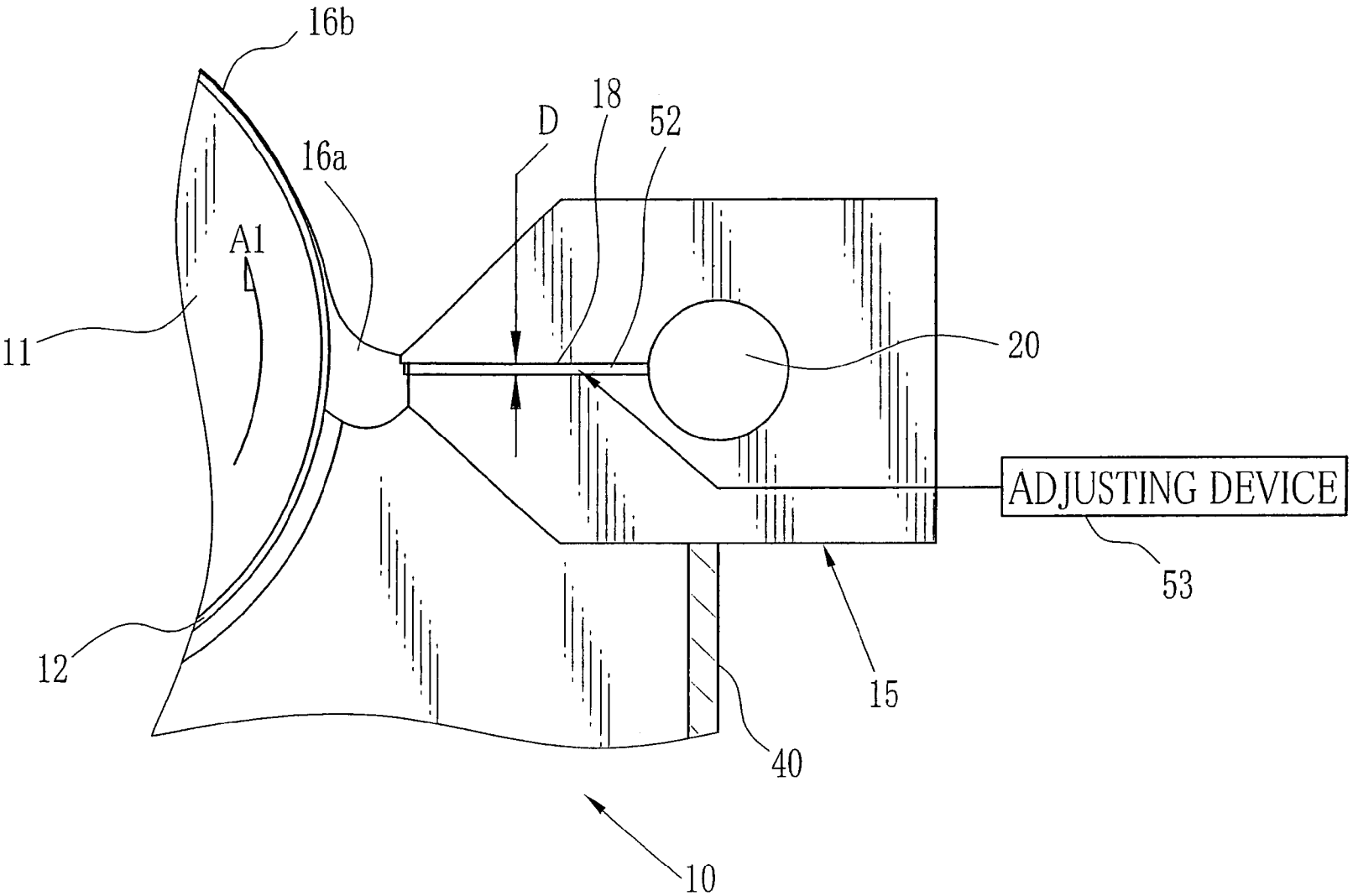
FIG. 7 is a side view of the coating apparatus.
Figure 8:
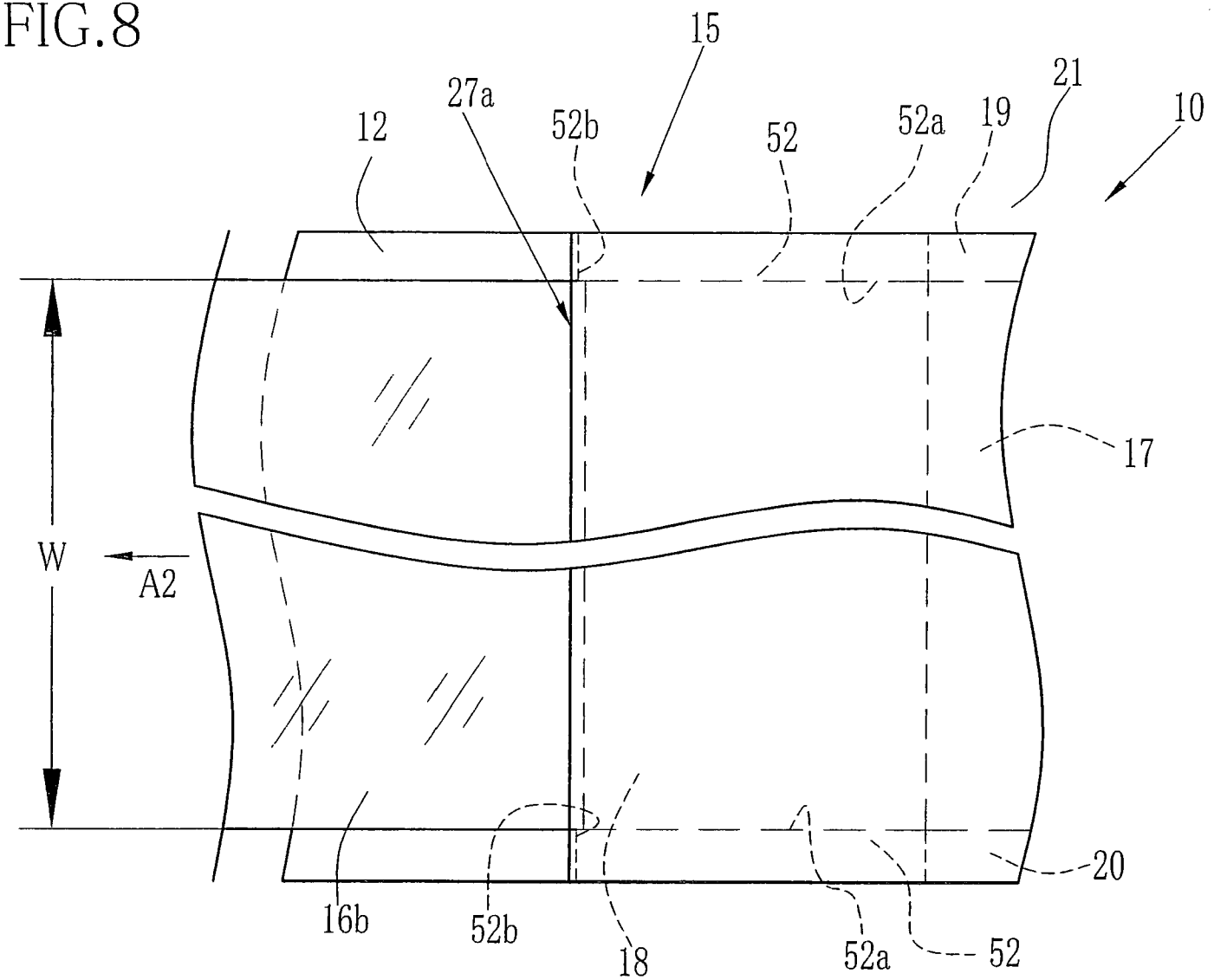
FIG. 8 is a plan view of a part of the die.

As shown in FIGS. 7 and 8, the regulation plates 52 are provided in both sides of the slot 18 in the widthwise direction of the die 15. Further, the distance between the regulation plates 52 are adjusted by the adjusting device 53 to become the almost same as a coating width W of the coating solution 16 on the web 12. Preferably the regulation plate 52 is formed of rigid materials in order to easily move in the slot 18. Concretely, the rigid material is metal, especially stainless, aluminum, hard material and the like. However, kinds of the material are not restricted in them. Note that the coating width W satisfies a condition 01.≦W≦5 m. However the coating width W is not restricted in this region.

Substantially, it is preferable a thickness of the regulation plate is as same as the distance $S_D$ of the slot in the feeding direction of the web 12. However, there is a case when the regulation plate 52 is hardly removable. Accordingly, the slot gap $S_D$ is 2-5 μm smaller than the slot gap $S_D$.

In the present invention, it is preferable that the slot gap $S_D$ satisfies a condition 50 μm≦SD≦500. However the slot gap is not restricted in it. Further, a contact face 52*a* of each of the regulation plates 52 becomes polluted by coating the coating solution 16 on the web 12. In order to easily cleanse, the face 52*a* may be coated with a coating polymer. As the coating polymer, there are, for example, a fluoride resin having the corrosion resistance, the small adhesive property to another material, and the like. However, the coating polymers are not restricted in them. As the most adequate fluoride resin, there us tetrafluoro ethylene and the like.

Note that the adjusting device 53 adjusts positions of front ends 51*b*, 52*b* of the regulation plates 52 in a direction in which the coating solution flows in the slot. In this embodiment, adjusting devices that are already known may be used. Note that the adjusting device 53 is disposed outside the die 15 such that the die 15 becomes smaller.

Figure 9:
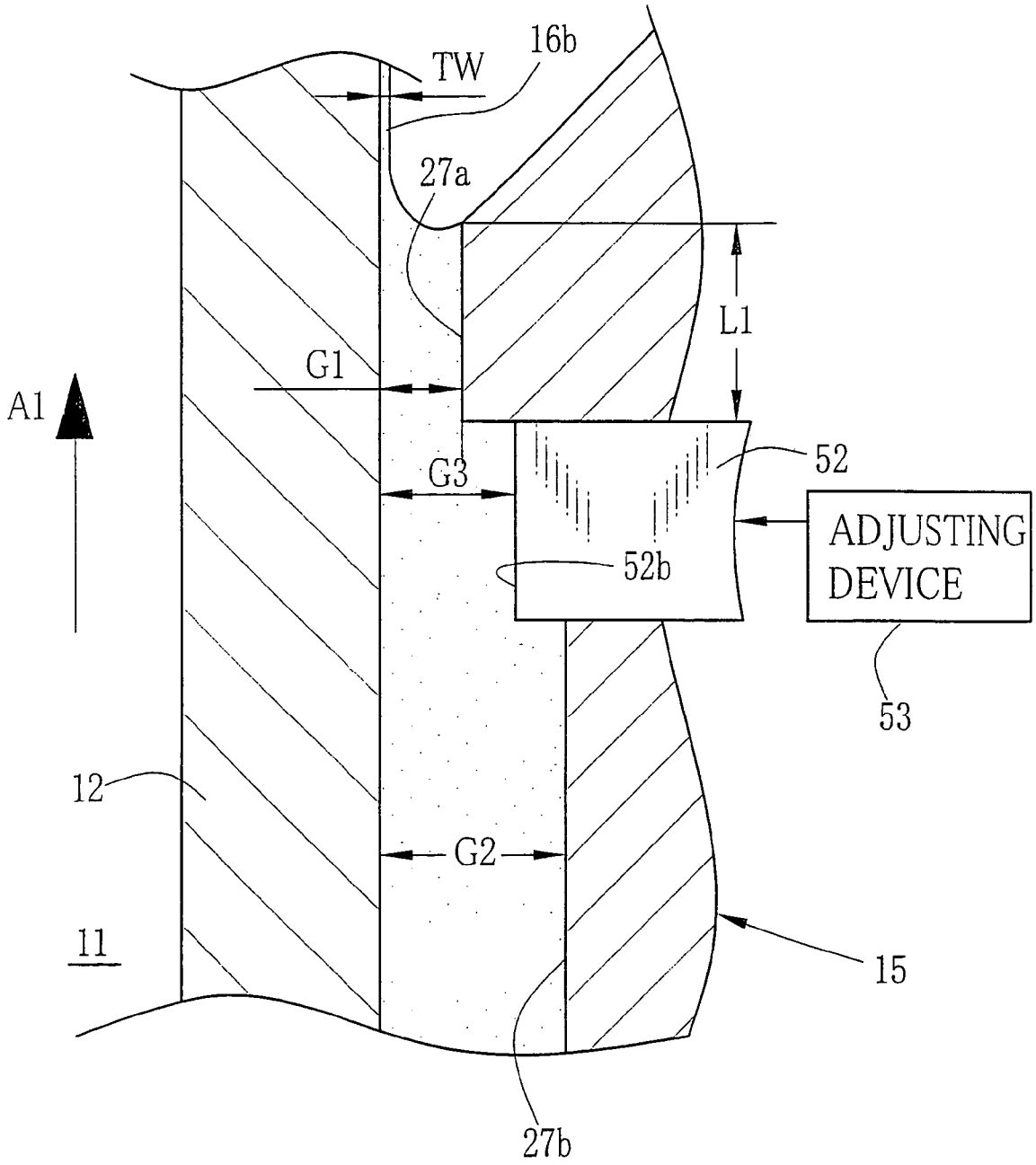
FIG. 9 is an extended view illustrating a positional relation between the die and the web.

As shown in FIG. 9, it is preferable in the die 15 that the gap $G_1$ between the web 12 and the first lip 25 satisfies 20 μm≦G1≦200 μm, and that the gap $G_2$ between the web 12 and the second lip 26 satisfies a condition 50 μm≦G2≦300 μm.

The ends 52*b* of the regulation plates 52 are positioned between the first and second lips 25, 26 to have a gap $G_3$ to the web 12. The gap $G_3$ satisfies a condition $G_1$<=$G_2$<=$G_3$, which prevents edges of the bead 16*a* from becoming unstable. It is especially preferable that the two regulation plates 52 are retracted from the first land 27*a*.

The coating solution is applied on the web 12 by using the die 15 including the regulation plates 52 such that the coating 16*b* may have a wet thickness TW less than 25 μm. Note that the wet thickness is determined as the thickness of the bead 26 in a stationary state exactly before drying.

Figure 10:
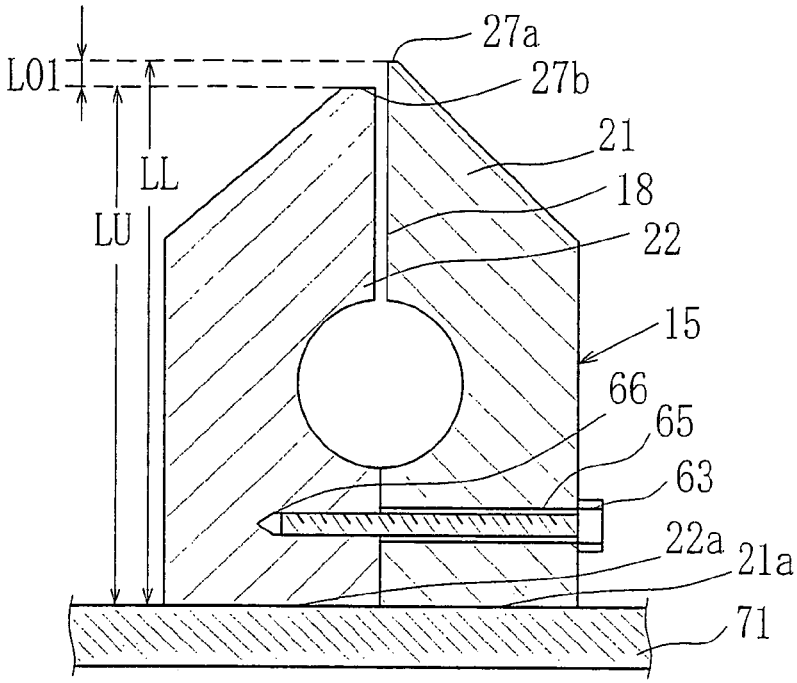
FIG. 10 is a sectional view illustrating a process for assembling a first embodiment of the die.

FIG. 10 illustrates a situation when the die 15 is assembled. The downstream block 21 and the upstream block 22 are mounted on an assembling base 71. A through-hole 65 is formed in the downstream block 21, and a female screw thread 66 in the upstream block 22.

There is a length LL from a rear surface 21*a* to the first lip land 27*a* in the downstream block 21, and a length LU from a rear surface 22*a* to the second lip land 27*b* in the upstream block 22. The die 15 has an overbite shape with a difference between the length LL and the length LU, which is determined as an overbite length $L_{o1}$. Note that the downstream block 21 and the upstream block 22 are formed with an accuracy of micrometer order. Thus, the die 15 has a predetermined overbite length $L_{o1}$ after assembling.

The assembling base 71 is formed to have a flat standard surface, on which the downstream block 21 and the upstream block 22 are loaded such that the rear surfaces 21*a*, 22*a* wholly contact to the flat surface of the assembling base 71. A bolt 63 is loosely fitted in the through-hole 65 to reach the female screw thread 66, and rotated to fix the downstream block 21 to the upstream block 22. Thereby, after fixing them to each other, the positional relation between the first and second lip lands can be set so as to obtain the predetermined overbite length. Note that the bolt 65 has a length until the middle of the upstream block 22 in this embodiment. However a length of the bolt 63 is not restricted in it. The bolt 63 may be inserted through the upstream block 22 and fixed with a bolt. In the method above, the improvement of techniques of forming the down- and upstream blocks 21, 22 reflects on assembling the die 15 to have the overbite length $L_{o1}$ accurately.

In the embodiment above, the assembling base 71 is made of SUS. However, the material is not restricted in it when the assembling base 71 has the flat surface for loading the downstream block 21 and the upstream block 22, and when the assembling base 71 is not broken by loading them.

Figure 11:
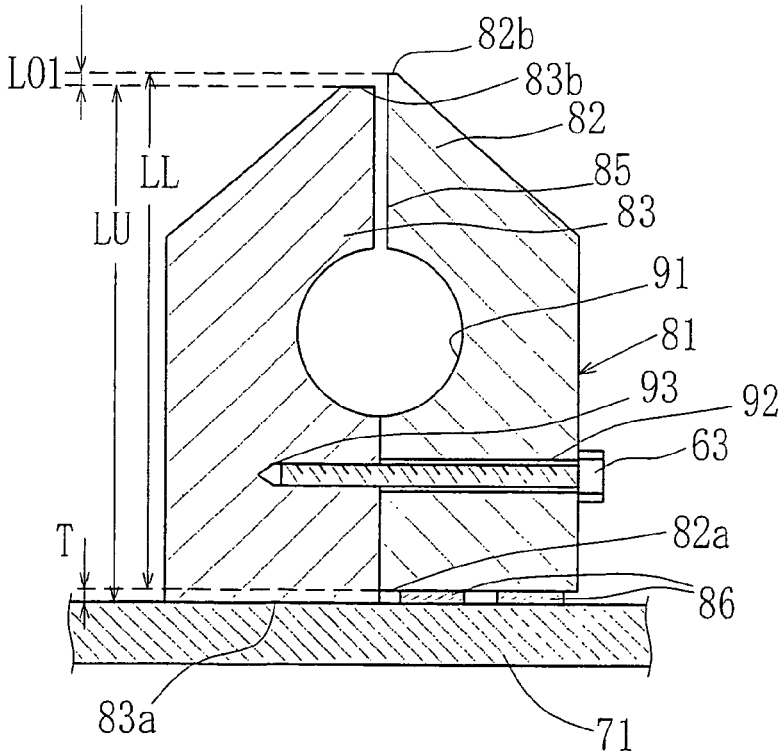
FIG. 11 is a sectional view illustrating a process for assembling a second embodiment of the die.

Now a preferable method for assembling the die of the present invention will be described now. As shown in FIG. 11, a die 81 is constructed of a downstream block 82 and an upstream block 83. The downstream block 82 has the length LL between a rear surface 82*a* and a first lip land 82*b*, and the upstream block 83 the length LU between a rear surface 83*a* and a second lip land 83*b*. While a rear surface 83*a* of the upstream block 83 contact to the flat surface of the assembling base 71, a thickness gages or a spacer 86 having a thickness T are provided between a rear surface 82*a* of a downstream block 82 and the assembling base 71. The thickness T of the thickness gage 86 can be adjusted in micrometer order. Accordingly the positional relation between the first and second lip lands 82*a*, 82*b* can be regulated by varying the thickness T of the thickness gage 86. Thus, the die 81 has an overbite length $L_{o1}$ or a height of a step between the lip lands 82*b* and 83*b*. Then the bolt 63 is inserted through a through-hole 92 and fitted in a female screw thread 93 of the upstream block 83. Thereby the down- and upstream blocks 82, 83 are fixed such that a positional relation between them may not change. Note that the thickness gage 86 is formed of such a material that it may not be broken while loading the downstream block 83.

The downstream block 82 and the upstream block 83 are contacted on their contact surfaces and slidable to each other thereby. Accordingly, the overbite length $L_{o1}$ may be optionally determined in micrometer order. Therefore the die can be formed to have the predetermined overbite length, independent of the shape of the downstream and upstream blocks. Further, when the length LL and the length LU are changed, the positional relation between the down- and upstream blocks 82, 83 are smoothly adjusted. This embodiment is especially effective when the down- and upper blocks are formed such that the length LU and the length LL are same. In this case, the thickness T of the thickness gage is previously adjusted to the overbite length $L_{o1}$.

Figure 12:
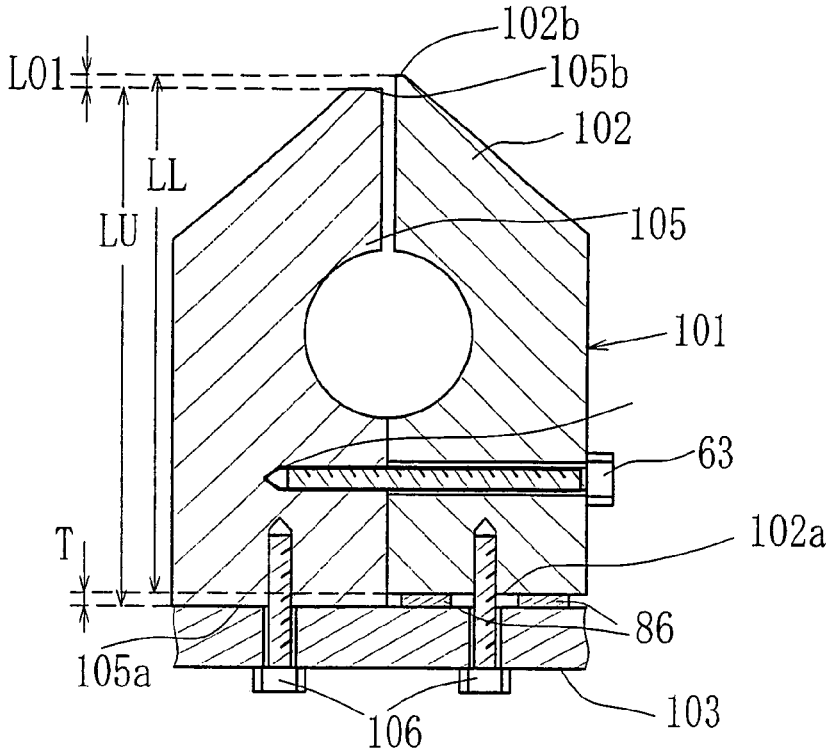
FIG. 12 is a sectional view illustrating a process for assembling a third embodiment of the die.

As shown in FIG. 12, a die 101 is constructed of a downstream block 102 and an upstream block 105. The downstream block 102 has the length LL between a rear surface 102*a* and a first lip land 102*b*, and the upstream block 102 the length LU between a real surface 105*a* and a second lip land 105*b*. The thickness gages or the spacers 86 are provided between the rear surface 102*a* of the downstream block 105 and a fixer 103.

After loading the down- and upstream blocks 102, 103 on the fixer 103, the thickness of the thickness gage 86 is adjusted such they have the overbite length $L_{o1}$ between a first lip land 102*b* and a second lip land 105*b*. Then, the down- and upstream blocks 102, 105 are fixed to each other by bolts 106. Thus it is prevented that the overbite length $L_{o1}$ varies. Note that the fixer 103 is formed of the SUS. However the Fixer 103 may effectively fix the positional relation between the down- and upstream blocks 102, 105. Accordingly, the materials are not restricted in it.

Figure 13:
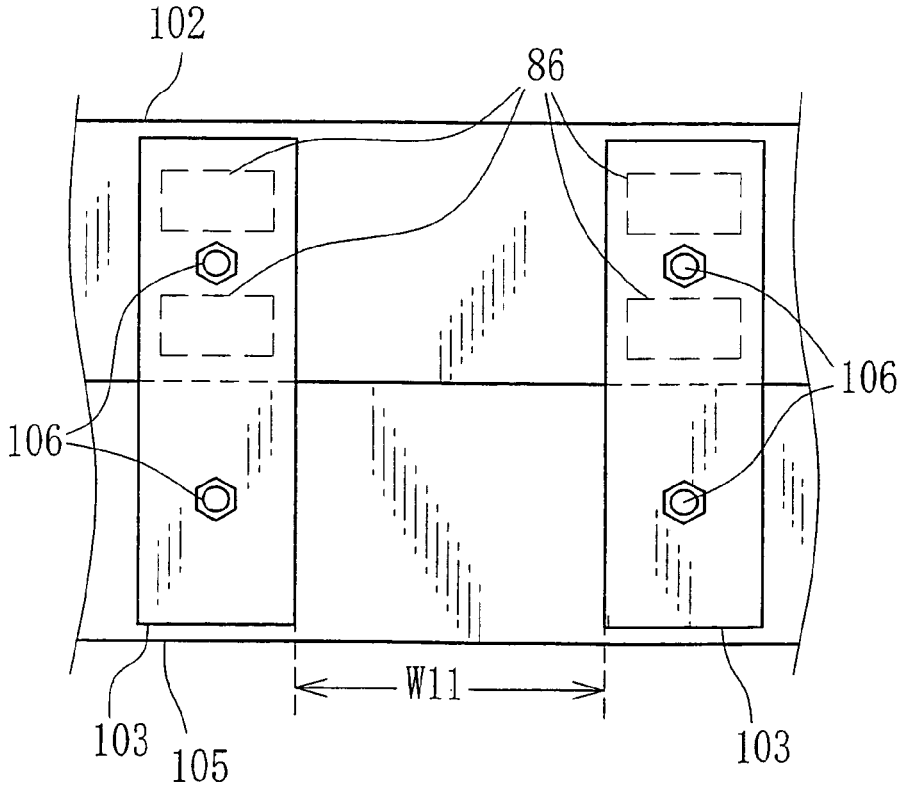
FIG. 13 is a plan view of a bottom of the die in FIG. 12.

In FIG. 13, the fixer 103 has a rectangular shape and an enough size for fixing the downstream block 102 and the upstream block 105. There is an interval W11 between the two fixers 103.

In each of the fixer 103, the two bolts 106 are provided for fixing the downstream block 102 and the upstream block 105 respectively. It is preferable that the interval W11 is between 5 cm and 50 cm. Further, when the down- and upstream blocks 102, 105 have a larger width, the positional relation between them tends to easily vary by fixing with the bolts 63. However, it is prevented, as each of the down- and upstream blocks 102, 105 are fixed with the bolts 106 to the fixer 103. Note that a number of the fixer 103 and an upper limit of the width $W_{11}$ may be set such that the positional relation between the down- and upstream blocks 102, 105 may not vary. Further, the bolts 106 may be removed after applying the bolts 63.

Figure 14:
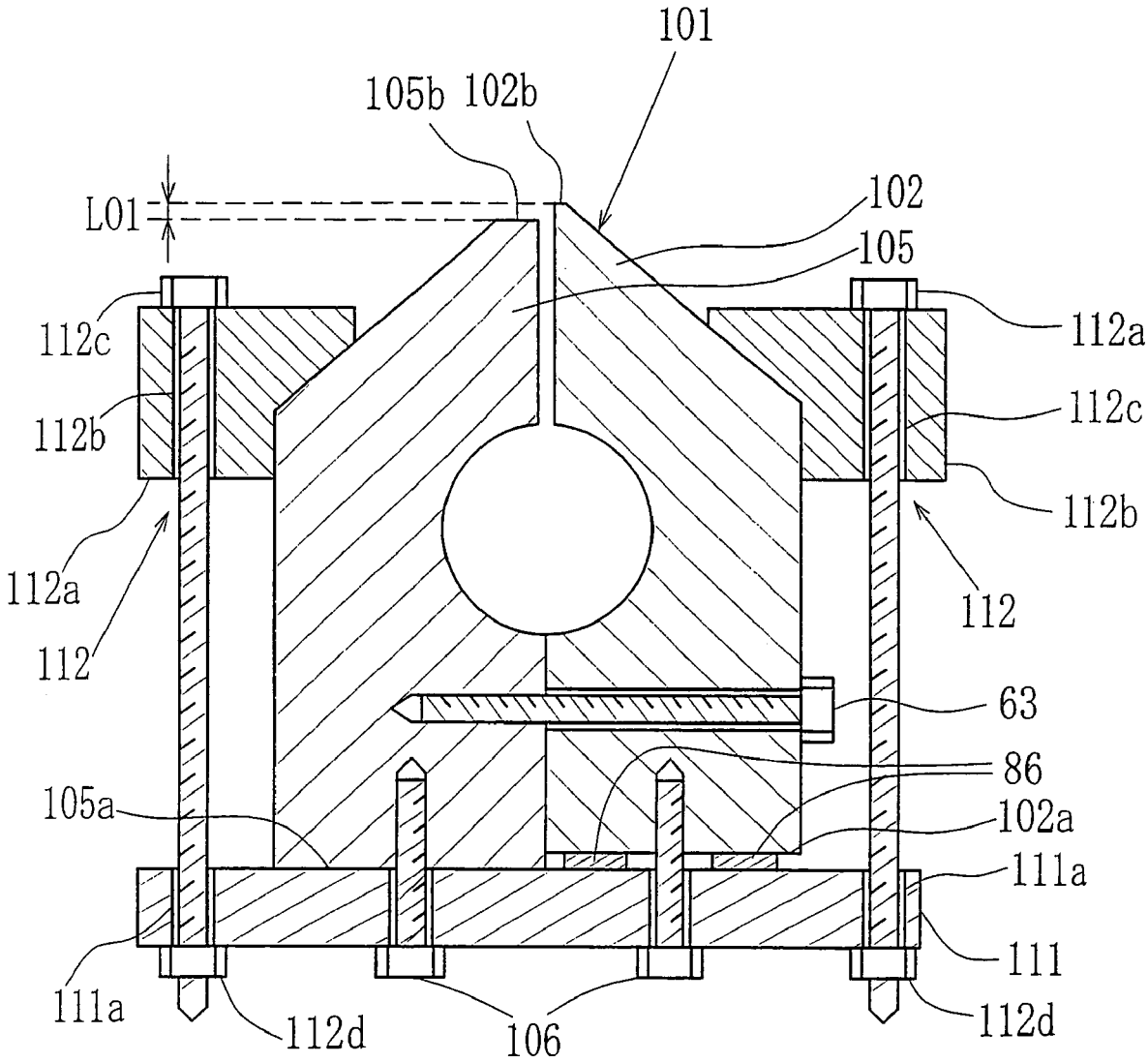
FIG. 14 is a sectional view illustrating a process for assembling a forth embodiment of the die.

As shown in FIG. 14, a fixer 111 may be provided with holding mechanism 112 for holding the downstream block 102 and the upstream block 105, when in determining an overbite length $L_{o1}$ between the first lip land 102*b* and the second lip land 105*b*. Each of the holding mechanism 112 includes a bolt 112*a*, a press member 112*b*, and a through-hole 112*c*. An end of the bolt 112*a* and the fixer 111 are fixed with a nut 112*d*. Further, the bolt 112*a* is inserted through the through-hole 112*c* of the press member 112*b* such that the press member 112*b* may be positioned at another end in the upside of the bolt 112*a*. Thereby the press member 112 contacts and presses the down- and upstream blocks 102, 105. Thus the overbite length $L_{o1}$ is adjusted more accurately. Note that the first lip land 102 and the second lip land 105 may not touch when the down- and upstream blocks 102, 105 are loaded on the fixer 111.

Note that the above method for assembling the die of the overbite type can be applied to form a die of underbite type. In the underbite type, an end of the upstream lip is protruded toward the web from an end of the downstream lip.

Figure 15:
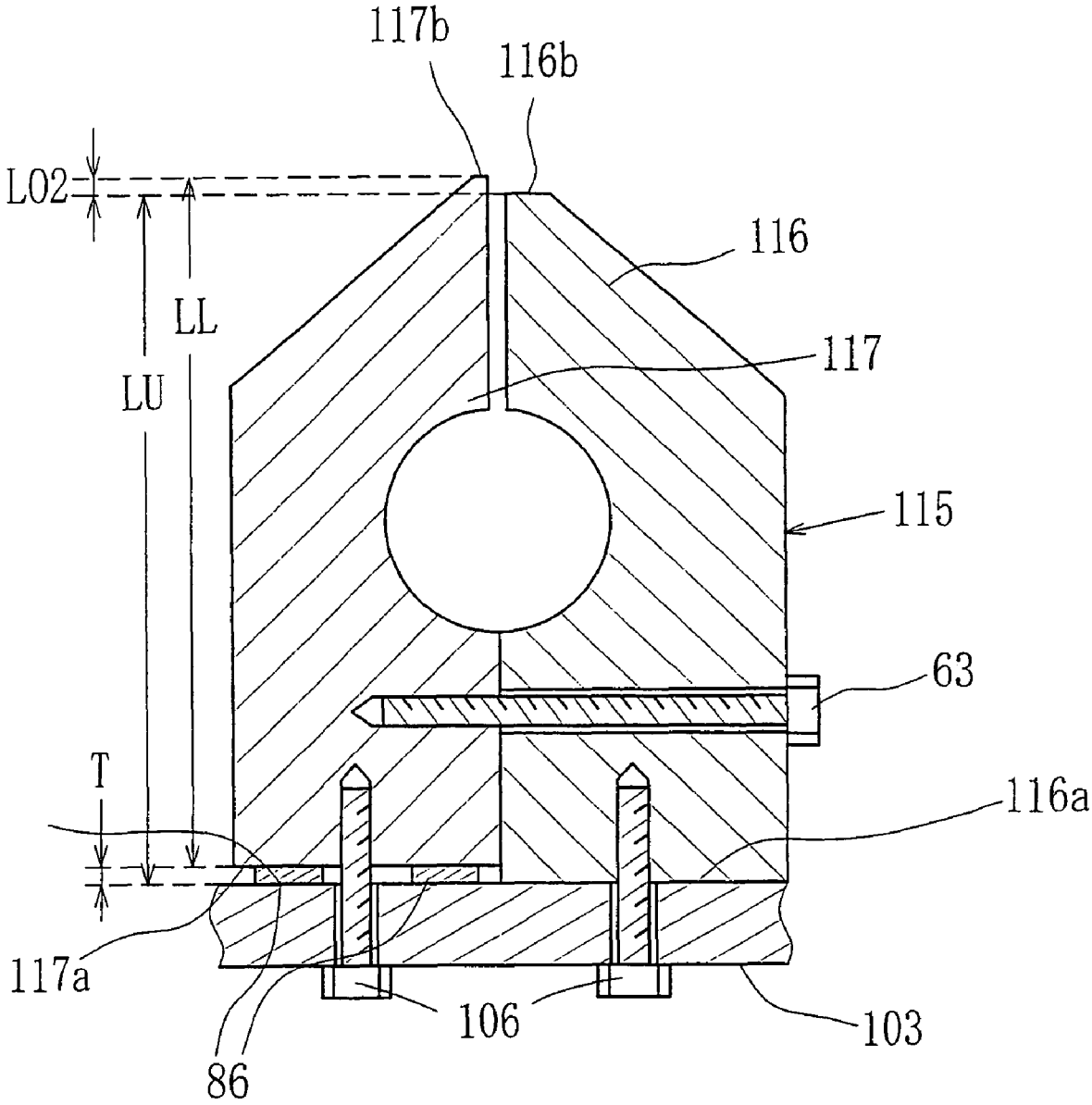
FIG. 15 is a sectional view illustrating a process for assembling a fifth embodiment of the die.

The die of the underbite type is assembled as follows. In FIG. 15, a die 115 of the underbite type is constructed of a downstream block 116 and an upstream block 117.

The downstream block 116 has the length LU between a rear surface 116*a* and a first lip land 116*b*, and the upstream block 117 the length LL between a rear surface 117*a* and a second lip land 117*b*. The thickness gages or the spacers 86 are provided between the rear surface 117*a* of the upstream block 117 and the fixer 103. The down- and upstream blocks 116, 117 are fixed to the fixer 103 with bolts 106. Thus there is a positional difference $L_{o2}$ between a first top end 102*b* and a second top end 105*b*. Thereafter, the down- and upstream blocks 116, 117 are fixed to each other with the bolts 63. Note that the holding mechanism 112 in FIG. 14 may be used in this method for assembling the die 115.

When the down- and upstream blocks for the underbite type are not formed in a predetermined shape, the thickness of the thickness gage disposed between the upstream block and the base is adjusted to obtain the underbite length $L_{o2}$. Note that the assemble of the die of the underbite type should be carried out on the base the same as in FIG. 10, when the down- and upstream blocks are previously formed to have the underbite length $L_{o2}$ as a difference between the length LL and the length LU. Also in this case, it is preferable to use the press section.

When the web is coated with the wet coating or the coating of the coating solution by using the die of the overbite or underbite type, the thickness of the wet single or multi-layer is equal to or more than 1 μm and equal to or less than 20 μm. In this case, a coating condition is dependent on setting the overbite length $L_{o1}$ and the underbite length $L_{o2}$. Accordingly the measure and the evaluation of such a length are made with accuracy in micrometer order.

Figure 16:
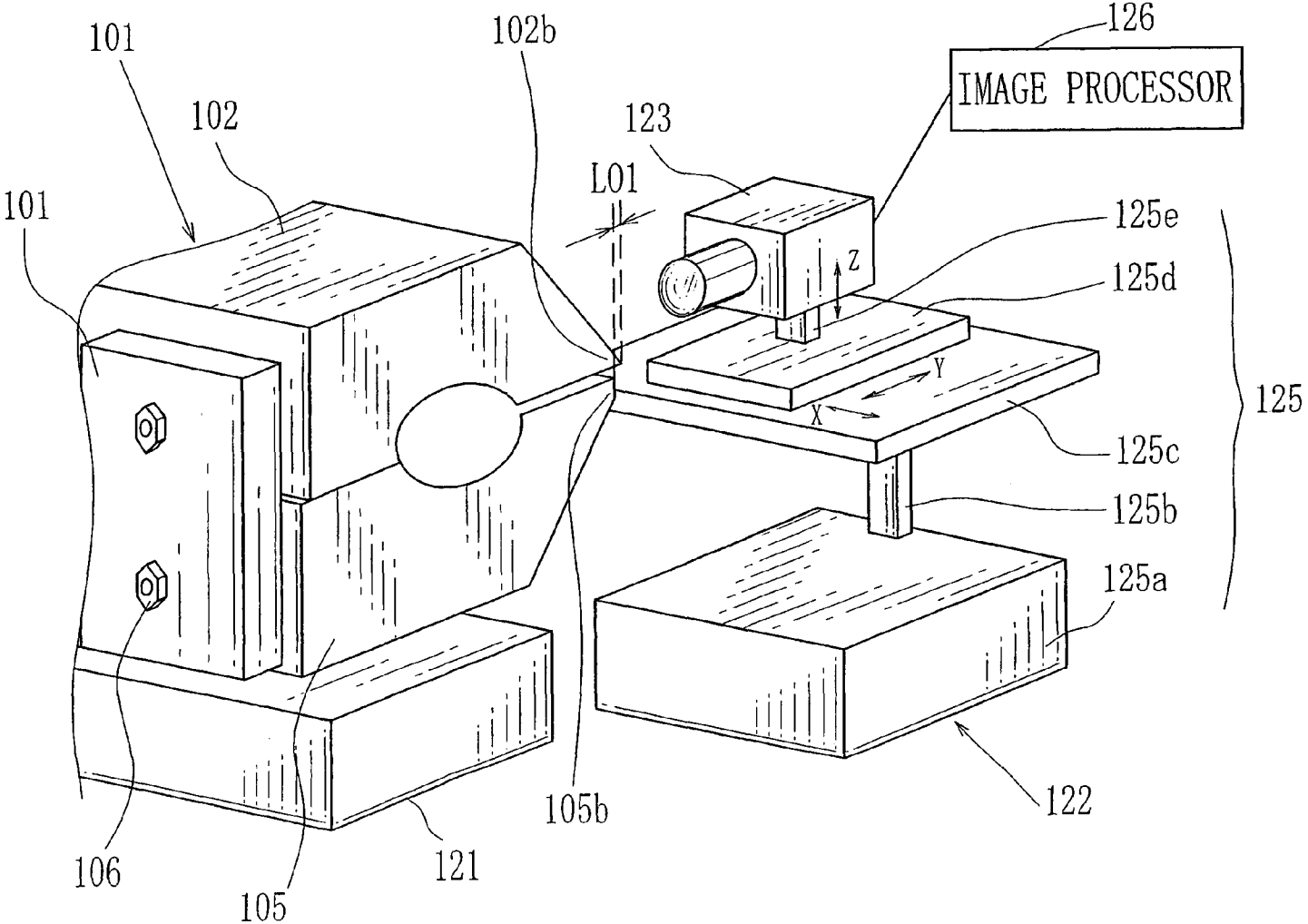
FIG. 16 is a first embodiment of measuring system for measuring the overbite length of the die.

A method of measuring the overbite length $L_{o1}$ will be explained as follows. In FIG. 16, the die 101 is loaded on a die stage 121 to set to a measuring apparatus 122. Thereby the upstream block 105 is positioned under the downstream block 102. The measuring apparatus 122 is constructed of the optical microscope 123 and a moving mechanism 122 for moving the microscope 123. The microscope 123 is connected with an image processor 126.

The moving mechanism 122 is constructed of a base 125*a*, a support member 125*b*, a first slide stage 125*c*, a second slide stage 125*d* and a shaft 125*e*. The base 125*a* sustains all elements of the moving mechanism 125, while the support member 125*b* is fixedly attached to the base 125*a*. The first slide stage 125*c* slides along the support member 125*b*, and the second slide stage 125*d* slides in X- and Y-directions. The shaft 125*e* is fixedly attached to the second slide stage 125*d*, and the optical microscope 123 slide on the shaft 125 in a Z-direction.

After loading the die 101 on the die stage 121 the first slide stage 125*c* is slid such that an end of the slot 18 is confronted to the microscope 123. Then the second slide stage 125*d* is moved in the X- and Y-directions and the microscope 123 in the Z-direction, so as to make a focusing of the microscope on an upstream edge of the first lip land 102*b*. Thus an image of the downstream edge of the first lip land 102*b* is taken in focus by the microscope 123, and data of the image is sent to the image processor 126. This position is determined as an origin. Thereafter, a downstream end of the second lip land 105*b* is photographed in focus, and a length in Y-direction from the origin is calculated. The length in the Y-direction is the overbite length $L_{o1}$. In measuring the overbite length $L_{o1}$, a surface of the die stage 121 should be formed with high accuracy. Thereafter, if the second slide stage 125 is moved in the X-direction, then distribution or a difference of the overbite length $L_{o1}$ can be measured.

When the die is set in another setting situation on the die stage, the overbite length $L_{o1}$ can be also measured by shifting the microscope in three directions each. Forms of the first and second lip lands 102*b*, 105*b* are determined in accordance with a tangent line at a position on the web that corresponding to a coating position of the die. Accordingly, data of the forms are input in the image processor 126 in order to make the measuring smoothly and accurately.

Figure 17:
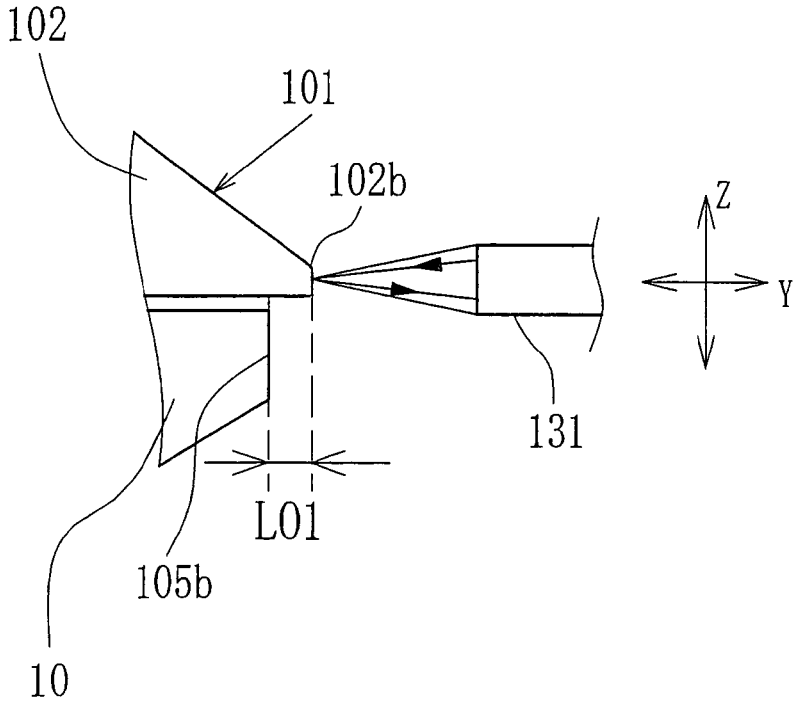
FIG. 17 is a second embodiment of measuring system for measuring the overbite length of the die.

When the measure is carried out, the die is set to the position in FIG. 16. As shown in FIG. 17 a laser meter 131 may be used instead of the microscope 123. The laser meter 131 emits a laser beam and receives a reflection which is reflected on the first lip land 102*b*. When there is protrusion or a retraction, the phase in the reflected laser varies.

When the measure is carried out, the laser beam is emitted on the first lip land 102*b* and the laser meter 131 is shifted in the Z-direction. The highest position in the Y-direction is determined as the origin. Thereafter, the laser meter is slid in the Z-direction above the second lip land 105*b*, and the lowest position in the Y-direction is detected. The overbite length $L_{o1}$ is calculated from the phase difference between the origin and the lowest position. When this operation is made in the X-direction, the distribution of the overbite length $L_{o1}$ is measured.

Figure 18:
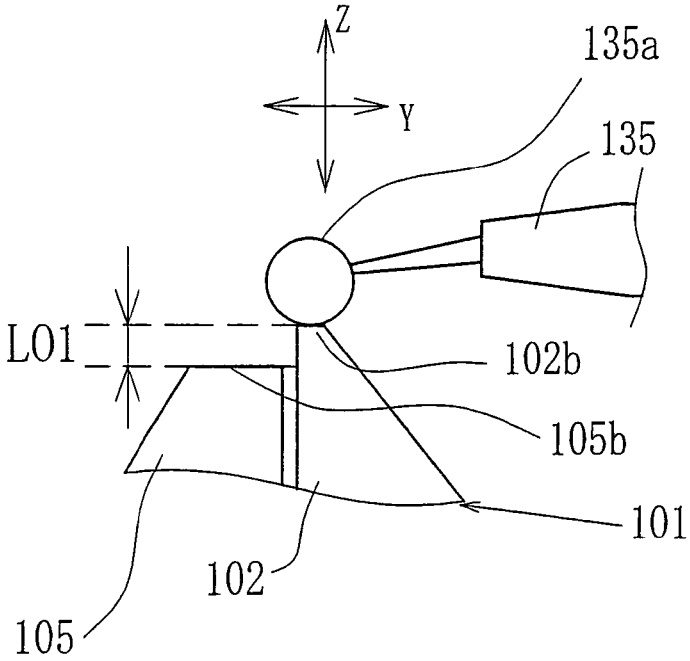
FIG. 18 is a third embodiment of measuring system for measuring the overbite length of the die.
Figure 19:
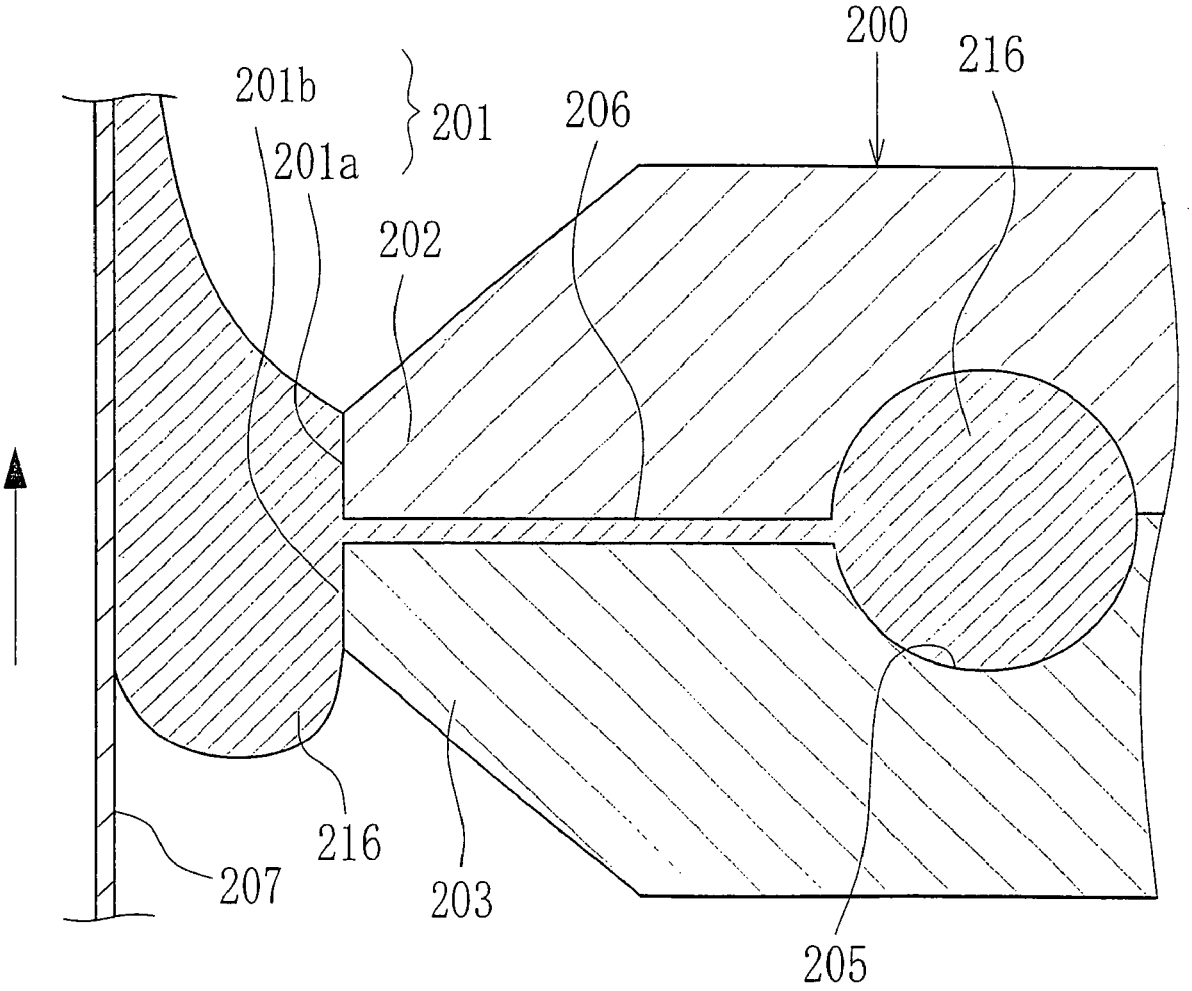
FIG.19 (PRIOR ART)
FIG. 19 is a schematic diagram of a die in prior art.

In FIG. 18, a dial gage 135 may be used for measuring the overbite length $L_{o1}$, instead of the microscope 123 and the laser meter 131. The dial gage 135 has a ball-like formed contact member 135*a*. At first, the die 101 is loaded on the stage 121 such that the first and second lip lands 102*b*, 105*b* are positioned uppermost. The contact member 135*a* is positioned so as to contact to the first lip land 102*b*. Then the contact member 102 is moved on the first lip land 102*b* in the Z-direction, and the highest position in the Y-direction is determined as the origin. The contact member 135*a* is further moved in the Z-direction on the second lip land 105*b*, and the lowest position in the Y-direction is detected. The difference of the lowest position to the origin is the overbite length $L_{o1}$. When this operation is made in the X-direction, the distribution of the overbite length $L_{o1}$ is measured.

When the die is set in another setting situation on the die stage, the overbite length $L_{o1}$ can be also measured by shifting the dial gage 135 or the laser meter 134 in each three directions. Note that the above methods for measuring the overbite length $L_{o1}$ are applied for measuring the underbite length $L_{o2}$. These methods are effective for carrying out the measure of the die for multi-layer coating.

When the dies 15, 81, 101 are assembled, the temperature thereof is adjusted to the same as the coating solution. As the material for the die is SUS, the volume and the size of the die depends on the temperature. Accordingly the temperature of the die is adjusted in considering not only the size of the surface but also the distribution of the temperature. Therefore the overbite length $L_{o1}$ and the underbite length $L_{o2}$ are measured with considering the deformation when in applying the coating solution on the web. Thus the die 15, 81, 101 are assembled with high accuracy.

Preferably, while the temperature of the coating solution is T ° C., the temperature of the die is adjusted between (T+5)° C. and (T-5) ° C. when in assembling it.

Preferably, the adjustment of the temperature is made by regulating the temperature of the atmosphere between (T+5)° C. and (T-5)° C., when the dies 15, 81, 101 are assembled, or when the overbite length or the underbite length is measured. Further, in the die is formed a passage for water. In the passage passes the water whose temperature is regulated between (T+5)° C. and (T-5)° C. Thus the adjustment of the temperature of the die is made. It is preferable that the water used therefor is refined in order to prevent the damage of the material of the die 15, 81, 101. An elapsed time for which the water passes in the passage depends on the temperature of the outer air, the water. However the elapsed time is more than two hours, preferably. Further, the temperature is effectively adjusted also, when a ribbon heater is wound around the die 15, 81, and 101. These methods for adjusting the temperature may be combined.

In the above embodiment, the die is a single layer coating type. However, the die of the present invention is not restricted in the above embodiments. For example, the die may be a multi-layer coating type.

The present invention is concretely explained with taking examples now. However, the present invention is not restricted in the following description. The method of applying the coating solution on the web and the die of the present invention are used in the examples and comparisons. In a process for producing the optical compensation sheet, the web is fed to a rubbing processing roller by a feeding machine with support of the guide roller. Thereafter, the coating process of the present invention is provided. Then the web is fed to instruments of drying, heating, and an ultraviolet lamp, and wound by a winding apparatus. The explanation of the Example 1 is made in detail at first. Thereafter, the same conditions as in Example 1 are omitted in the explanation for other Examples and comparisons.

Note that the web, after applying the coating solution, is fed in the drying instrument set to 100° C., and in the heating instrument set to 130° C. Then an ultraviolet ray is projected from the ultraviolet lamp onto a surface of the coating on the web.

Example 1

A web base of the web 12 has a thickness of 100 μm, and is formed of triacetyl cellulose (Fuji tack, Fuji Photo Film Co. LTD). On a surface of the web base, 25 ml of 2 wt. % solution of chain alkyl denaturated poval (MP-203, Kuraray Co. Ltd.) is applied, and thereafter dried in 60° C. for a minute to form a coating.

Then the web base on which a layer of resin for orientation film is fed to a rubbing processing roller, and a rubbing processing is carried out on a surface of the resin layer to form an orientation layer. A pressure of a rubbing roller is applied at $9.8\times10^{-3}$ Pa and a rotational speed is 5.0 m/sec during the rubbing processing. Thus the web 12 is prepared.

The coating solution 13 contains TE-8, optical polymerization initiator (Irgacure 907, Chiba Gaigy Japan) at 1%, and methylethylketon at 40 wt. %. The TE-8 is discotic compound and has alkyl groups R(1) and R(2) in ratio of 4:1 (R(1):R(2)).

In a die, a land length $L_1$ of a first land lip is 100 μm, and a land length $L_2$ of a second land lip is 1 mm. A coating solution is applied on the web at 5 ml/m$^2$, such that a thickness of a wet coating may be 5 μm. The feeding speed of the web is 10 m/min. The gap $G_1$ between the web 12 and the first land 27*a* is set to 40 μm.

In Example 1, the bead was split and the coating could not be carried out, and the pressure decreasing degree was 1000 Pa.

TE-8

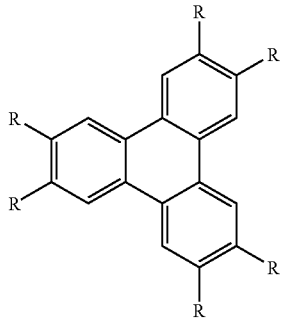

R(1)

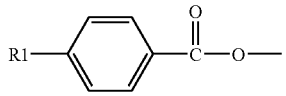

R(2)

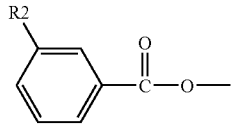

R1 = n-$C_8H_{17}O$
R2 = n-$C_5H_{11}O$

Example 2

In Example 2, the feeding velocity was 20 m/min. Other conditions were the same as in Example 1. In Example 2 the pressure decreasing degree was 1800 Pa. The coating is made without problem.

Example 3

In Example 3, the feeding velocity was 30 m/min. Other conditions were the same as in Example 1. The bead was split and the coating could not be carried out.

Example 4

In Example 4, the feeding velocity was 40 m/min. Other conditions were the same as in Example 1. The bead was split and the coating could not be carried out.

Example 5

In Example 5, the land length $L_1$ of the first land lip was 50 μm. Other conditions were the same as in Example 1. In Example 5 the pressure decreasing degree was 600 Pa. The coating is made without problem.

Example 6

In Example 6, the land length $L_1$ of the first land lip was 50 μm. Other conditions were the same as in Example 2. In Example 6 the pressure decreasing degree was 1000 Pa. The coating is made without problem.

Example 7

In Example 7, the land length $L_1$ of the first land lip was 50 μm. Other conditions were the same as in Example 3. In Example 7 the pressure decreasing degree was 1500 Pa. The coating is made without problem.

Example 8

In Example 6, the land length $L_1$ of the first land lip was 50 μm. Other conditions were the same as in Example 8. In Example 8 the pressure decreasing degree was 2000 Pa. The coating is made without problem.

[Comparison 1]

In Comparison 1, the land length $L_1$ of the first land lip was 200 μm. Other conditions were the same as in Example 1. The bead was split and the coating could not be carried out.

[Comparison 2]

In Comparison 2, the land length $L_1$ of the first land lip was 200 μm. Other conditions were the same as in Example 2. The bead was split and the coating could not be carried out.

[Comparison 3]

In Comparison 3, the land length $L_1$ of the first land lip was 200 μm. Other conditions were the same as in Example 3. The bead was split and the coating could not be carried out.

[Comparison 4]

In Comparison 4, the land length $L_1$ of the first land lip was 200 μm. Other conditions were the same as in Example 4. The bead was split and the coating could not be carried out.

[Comparison 5]

In Comparison 5, the land length $L_1$ of the first land lip was 10 μm. Other conditions were the same as in Example 1. In Comparison 5 the pressure decreasing degree was 300 Pa. The coating is made without problem.

[Comparison 6]

In Comparison 6, the land length $L_1$ of the first land lip was 10 μm. Other conditions were the same as in Example 2. At first the coating was made. However, the bead was split after few minutes, and the coating could not be carried out.

[Comparison 7]

In Comparison 7, the land length $L_1$ of the first land lip was 10 μm. Other conditions were the same as in Example 3. At first the coating was made. However, the bead was split at the same part as in Comparison 6 after few minutes, and the coating could not be carried out.

[Comparison 8]

In Comparison 8, the land length $L_1$ of the first land lip was 10 μm. Other conditions were the same as in Example 4. At first the coating was made. However, the bead was split at the same part as in Comparison 6 after few minutes, and the coating could not be carried out.

The results in the Examples 1-8 and Comparisons 1-8 teach that the land length of the first lip land is preferably between 30 μm and 100 μm. Further, when the land length is shorter, the effects become larger.

Example 9

Lips of the die were formed of materials whose main content was hard material of WC. Other conditions were the same as in Example 7. The land length $L_1$ of the first lip land was measured with the laser meter. The land length was between 30 μm and 50 μm. A variation of the land length was 20 μm. The examination was made with eyes, and the coating solution was applied on the web without problems.

[Comparison 9]

Lips of the die were formed of stainless alloy. Other conditions were the same as in Example 9. The land length $L_1$ of the first lip land was measured with the laser meter. The land length was between 0 μm and 40 μm. A variation of the land length was 40 μm at the maximal. When 5 minutes passed after start of applying the coating solution, the bead was split and stripes are generated in the coating on the web.

The results in the Example 9 and Comparison 9 teach the variation of the land length $L_1$ is preferably smaller. When the lips made of the hard alloy are used, the effect becomes larger.

As described above, the bead is formed in an adequate shape by using the method and the apparatus for coating the web of the present invention. Thus the stripes are not generated in the coating and the coating solution is continuously applied on the web.

Example 10

In the die used for Example 10, the land length $L_1$ of the first lip land was 50 μm, the land length $L_2$ of the second lip land was 150 μm, and the length $L_S$ of the slot was 50 mm. The web was fed at 50 m/min to applying coating solution on the web, such that the thickness of the wet coating was 5 μm. The gap $G_1$ between the first land and the web was set to 50 μm. The gap $G_S$ between the side plate and the web and the gap $G_B$ between the back plate and the web were set to 100 μm.

After drying the coating and winding the web, the examination of unevenness is made with eyes. In Example 10, the coating was made without problems. The pressure decreasing degree necessary for fixing the bead to the upper end of the upstream lip was 1700 Pa. The coating solution was applied at a predetermined width. Further, there was no unevenness in the coating. The coating was made without problems.

Example 11

In Example 11, the overbite length $L_{o1}$ was set to 100 μm. Other conditions were the same as in Example 10. In Example 11 the pressure decreasing degree was 1700 Pa. The coating solution was applied at a predetermined width. Further, there was no unevenness in the coating. The coating was made without problems.

Example 12

In Example 12, the gap $G_B$ between the web and the back plate were set to 300 μm. Other conditions were the same as in Example 10. In Example 12 the pressure decreasing degree was 1700 Pa. The coating solution was applied at a predetermined width. Further, there was no unevenness in the coating. The coating was made without problems.

[Comparison 10]

In Comparison 10, the overbite length $L_{o1}$ was set to 0 μm. Other conditions were the same as in Example 10. In Comparison 11 the pressure decreasing degree was 2500 Pa. Edges of the coating becomes wider, and the width thereof becomes larger than the predetermined one. Further, there was unevenness in the coating.

[Comparison 11]

In Comparison 11, the overbite length $L_{o1}$ was set to 200 μm. Other conditions were the same as in Example 10. In Comparison 11 the pressure decreasing degree was 1500 Pa. The width thereof was the predetermined one. However, when a minute passed after start of applying the coating solution, the bead was split, and the coating was not made any more.

[Comparison 12]

In Comparison 12, the land length $L_1$ of the first land lip was 200 μm. Other conditions were the same as in Example 1. The bead was split and the coating could not be carried out.

[Comparison 13]

In Comparison 13, the gaps between the web and the back plate were set to 50 μm. Other conditions were the same as in Example 10. In Comparison 13 the pressure decreasing degree plate were set to 50 μm. Other conditions were the same as in Example 10. In Comparison 13 the pressure decreasing degree was 1700 Pa. The coating solution was applied at a predetermined width. The coating was made. However, the unevenness was generated in the coating.

The results in the Examples 10, 11 and Comparisons 10-12 teach that the land length $L_1$ of the first lip land is preferably between 30 μm and 100 μm. Further, the bead can be fixed to the upper end of the lip in the upstream side more easily, when the overbite length $L_{o1}$ becomes larger. Especially the overbite length $L_{o1}$ satisfies 30 μm≦LO0≦100 μm, in order to make the shape of the bead stable and to prevent the generation of unevenness in the coating.

Example 13

Conditions of forming the web 12 are changed as follows. A web base of the web 12 is formed of cellulose triacetate (Fuji tack, Fuji Photo Film Co. LTD) to have the width of 100 mm. Before applying the coating solution, a hard-coating layer is formed of a hard-coating solution on the web. In the hard-coating solution, a hard coating compound of ultraviolet hardening (desolite Z-7526, 72 wt. %, JSR Co. LTD) at 250 g is solved in solvent of methylethylketone 62 g and cyclohexane 88 g. The hard-coating solution is applied on the web at 8.6 ml/m$^2$. Thereafter, the wet coating is dried at 120° C. for five minutes. Then an ultraviolet ray is projected from an air cool metal halide lamp (Eyegraphics Co. LTD) whose power was 160 W/cm. Thus the hard coat layer has a thickness 25 μm. Thus the web 12 is formed.

The coating solution is prepared as follows: A mixture of dipenta elithlitol petaacrylate and dipenta elithlitol hexaacrylate (DPHA, Japan Chemical Co., LTD) is prepared. The mixture at 91 g is solved in a solution at 218 g (Dezolite Z-7526, Produced by JSR Co., LTD) containing zirconium oxide for hard coat layer, to produce a mixture solution. The mixture solution is supplied into a mixture solvent of methylethylketone and cyclohexanone in ratio 4:6 in weight percent, and adding further thereto 10 g of optical polymer initialyzer (Irgacure 907, Chiba Gaigy Japan). Thus the coating solution is produced.

After forming the hard coat layer, the coating apparatus was applied on the web at 4.2 ml/$m^2$. the coating speed is set to 30 m/min. The gap $G_1$ between the first lip land and the web is set to 40 μm, and the overbite length $L_{o1}$ is 75 mm. The land length $L_1$ of the first lip land, the land length $L_2$ of the second lip land, the gap $G_S$ between the web and the vacuum chamber are set the same as in Example 10. In Example 13, the pressure decreasing degree was 1700 Pa, and only few of the unevenness was generated in the coating. The coating is made without problem.

Example 14

In Example 14, the gap $G_B$ between the web and the back plate were set to 300 μm. Other conditions were the same as in Example 13. In Example 14 the pressure decreasing degree was 1700 Pa. The coating solution was applied at a predetermined width. Further, there was no unevenness in the coating. The coating was made well.

[Comparison 14]

In Comparison 14, the overbite length $L_{o1}$ was set to 0 μm. Other conditions were the same as in Example 13. In Comparison 14, when the pressure decreasing degree was less than 2500 Pa, the coating was not stably made, and the unevenness was generated in the coating.

[Comparison 15]

In Example 15, the gap $G_B$ between the web and the back plate were set to 400 μm. Other conditions were the same as in Example 13. In Comparison 15 the pressure decreasing degree was 1700 Pa. However, the unevenness was generated in the coating.

The results in the Examples 13, 14 and Comparisons 14, also teach that the overbite length $L_{o1}$ satisfies 30 μm≦LO1≦100 μm. Further, when the gap $G_B$ between the web and the back plate is adjusted, the generation of the unevenness is prevented moreover.

Example 15

The regulation plates 52 were provided in the slot 16, and a thickness of the regulation plate was 145 μm. The coating speed is set to 60 m/min. The gap $G_1$ between the first lip land 27*a* and the web 12 was set to 40 μm. The overbite length $L_{o1}$ was 50 μm. The pressure decrease degree for the upper meniscus of the bead 16*a* was 2500 Pa. The regulation plate was formed of stainless, and retracted from the first lip land at 25 μm. In Example 15, other conditions were the same as in Example 1. The examination was made with eyes, and the coating solution was applied on the web without problems.

Example 16

The gap $G_3$ from the regulation plate 52 to the web 12 was set to 50 μm. Thus the regulation plate 52 and the second lip land 27*b* were disposed on the same surface. In Example 15, other conditions were the same as in Example 1. The pressure decrease degree for the upper meniscus of the bead 16*a* was 2500 Pa. The edges of the bead 16*a* were stable.

Example 17

The gap $G_3$ from the regulation plate 52 to the web 12 was set to 0 μm. Thus the regulation plate 52 and the first lip land 27*b* were disposed on the same surface. In Example 15, other conditions were the same as in Example 16. The pressure decrease degree for the upper meniscus of the bead 16*a* was 2500 Pa. The edges of the bead 16*a* were little unstable. However, the coating was made without problems.

[Comparison 16]

The gap $G_3$ was set to 60 μm. Other conditions were the same as in Example 16. The edges of the bead 16*a* were split and the coating was not made.

Examples 15-17 and Comparison 16 teach that the regulation plates has a larger distance to the web than the first lip land and a smaller distance than the second lip land, in order to form the adequate coating. Namely, the gap $G_3$ between the regulation plate and the web is the same as or larger than the gap $G_1$ between the first lip land and the web, and the same as or smaller than the gap $G_2$ between the second lip land and the web.

Example 18

In the downstream block 102, the land length $L_1$ of the first lip land 102*b* is 50 μm, and the length LL between the rear surface 102*a* and the first lip land 102*b* is 200.000 mm. In the upstream block 105, the land length $L_2$ of the second lip land 105*b* is 1 mm, and the length between the rear surface 105*a* and the second lip land 105*b* is 200.000 mm. The down- and upstream blocks 102, 105 are mounted on the fixer 111, and the thickness gage 86 having the thickness T of 50 μm is provided between the downstream block 102 and the fixer 111. A pressure is applied to the down- and upstream blocks 102, 105 with the holding mechanism 112 to press to the fixer 111. Then the down- and upstream blocks 102, 105 are fixed to the fixer 111 with bolts 106, and thereafter fixed to each other with the bolts 63.

The temperature in a room for assembling the die was set to 22° C., the water of 22° C. passed through the passage provided in the two blocks 102, 105 for two hours. Thus the temperature of the blocks 102, 105 was adjusted to 22 Y. The overbite length $L_{o1}$ was measured with the optical microscope 123 and adjusted to be 50 μm. The holding mechanism 112, the fixer 111, the bolts 106 and the thickness gage 86 were removed after adjustment of the overbite length $L_{o1}$.

Then the coating solution was applied to form the wet coating 5 μm the web which was fed at 50 m/min. The temperature of the coating solution was 22° C. The pressure decrease degree was set to 1600 Pa, whose variation was measured with a digital manometer. Other conditions were the same as in Example 1. after drying the coating, the examination was carried out with eyes. In Example 18, the unevenness was not generated in the coating, and the conditions of the coating were excellent.

Example 19

In Example 19, the pressure section was not used. Other conditions were the same as in Example 18. The unevenness was not generated in the coating, and the conditions of the coating were excellent.

Example 20

In the downstream block 102, the land length $L_1$ of the first lip land 102*b* is 50 μm, and the length LL between the rear surface 102*a* and the first lip land 102*b* is 150.000 mm. In the upstream block 105, the land length $L_2$ of the second lip land 105*b* is 1 mm, and the length between the rear surface 105*a* and the second lip land 105*b* is 150.000 mm. The down- and upstream blocks 102, 105 are mounted on the assembling base 71, and the thickness gage 86 having the thickness T of 50 μm is provided between the downstream block 102 and the assembling base 71. Then the down- and upstream blocks 102, 105 are fixed to the assembling base 111 with bolts 92, and thereafter fixed to each other with the bolts 63. The overbite length $L_{o1}$ was measured with the optical microscope 123 and adjusted to be 50 μm. Other conditions were the same as in Example 1. In Example 20, the unevenness was not generated in the coating, and the applying of the coating solution was made without problems.

Example 21

In the downstream block 102, the land length $L_1$ of the first lip land 102*b* is 50 μm, and the length LL between the rear surface 102*a* and the first lip land 102*b* is 150.050 mm. In the upstream block 105, the land length $L_2$ of the second lip land 105*b* is 1 mm, and the length between the rear surface 105*a* and the second lip land 105*b* is 150.000 mm. The down- and upstream blocks 102, 105 are mounted on the assembling base 71, and the thickness gage 86 having the thickness T of 50 μm is provided between the downstream block 102 and the assembling base 71.

Then the down- and upstream blocks 102, 105 are fixed to the assembling base 111 with bolts 92, and thereafter fixed to each other with the bolts 63. The overbite length $L_{o1}$ was 50 μm. Other conditions were the same as in Example 18. In Example 20, the unevenness was not generated in the coating, and the applying of the coating solution was made without problems.

Example 22

For regulating the temperature of the die 101, instead of the water, the ribbon heater was wound around the die for two hours. Other conditions were the same as in Example 18. In Example 18, the unevenness was not generated in the coating, and the applying of the coating solution was made without problems.

Example 23

The adjustment of the overbite length $L_{o1}$ was carried out with the dial gage 135. Other conditions were the same as in Example 18. In Example 18, the unevenness was not generated in the coating, and the applying of the coating solution was made without problems.

Example 24

The adjustment of the overbite length $L_{o1}$ was carried out with the laser meter 131 (named LC-2400, produced by KEYENCE CORPORATION. Other conditions were the same as in Example 18. In Example 18, the unevenness was not generated in the coating, and the applying of the coating solution was made without problems.

[Comparison 17]

when the die 101 was assembled, the temperature thereof was not regulated. The overbite length $L_{o1}$ was measured with the optical microscope 123 and adjusted to be 50 μm. The temperature in the room for assembling the die was 15° C. Other conditions were the same as in Example 18. In Comparison 18, then the coating was carried out, the two blocks was deformed. Thus the largest difference between the maximum and the minimum of the gap $G_1$ between the first lip land 102*b* and the web 12 was 10 μm, when the gap $G_1$ is measured at each point on the first lip end 102*b*. Therefore the bead 16*a* was split at extended parts thereof, and the coating was not made any more.

Example 25

The kind of the web and the method of processing the surface of the web are the same as in Example 13. The overbite length $L_{o1}$ was measured with the optical microscope 123 and adjusted to be 50 μm. The method of assembling the die 101 and other conditions were the same as in Example 18. There was no unevenness in the coating. The coating was made well.

The Examples 18-25 and Comparison 17 teach that the method of assembling the die, in which the blocks of the die were fixed the overbite length $L_{o1}$. Further, in the method the setting of the overbite length $L_{o1}$ was made accurately and smoothly. Further the adjustment of the temperature is important for assembling the web.

Various changes and modifications are possible in the present invention and may be understood to be within the present invention.

What is claimed is:

1. A method for producing a film product including at least one dried coating layer by applying a coating solution on a web using a slot die coater and drying the applied coating solution, said slot die coater including a die with a slot, which has a slot discharging mouth for discharging said coating solution, said method comprising:

feeding said web continuously while supporting said web on a back-up roller;

discharging said coating solution from said slot discharging mouth disposed close to said web, for forming a bead of said coating solution between said slot discharging mouth and said web; and reducing pressure around said bead of said coating solution in an upstream side of a feeding direction of said web from said bead of said coating solution;

wherein said slot discharging mouth is formed between a first lip and a second lip, said first lip being disposed downstream from said second lip in a feeding direction of said web, an end of said first lip having a first lip land which is flat and confronted to said web, and an end of said second lip having a second lip land which is flat and confronted to said web said first lip land satisfying a condition, $$30\ \mu m \leqq L_1 \leqq 60\ \mu m$$

wherein $L_1$ is an average length of the first lip land in said feeding direction, wherein the length $L_1$ of said first lip land is smaller than a length of said second lip land, wherein at least said first lip is formed of hard alloy in which carbide crystal is contained, wherein a first length defined by a first gap $G_1$ between said first lip land and said web is smaller than a second length defined by a second gap $G_2$ between said second lip land and said web, and wherein a length difference LO1 between said first length defined by said first gap and said second length defined by said second gap $G_2$ satisfies 30 μm≦LO1≦120 μm.

2. A method as claimed in claim 1, wherein a difference between a maximum and a minimum of the length $L_1$ measured at each point of said first lip land is less than 20 μm.

3. A method as claimed in claim 1, wherein a vacuum chamber is disposed so as to surround a lower side of said back-up roller and said slot die coater, said vacuum chamber is nearly box-shaped and has a back plate disposed in a lower side of said back-up roller and a front plate disposed in a lower side of said slot die coater, wherein a gap between said back plate and said web is larger than said second gap.

4. A method as claimed in claim 3, wherein a range of a difference in a width direction of said slot die coater between a maximum and a minimum length of said first gap $G_1$ between said first lip and said web at coating is set such that a difference of h which is calculated in the following formula (1) as $P_O$-$P_P$ is constant in said width direction is equal to or less than 2% in said width direction of said slot die coater, $$P_O P_P = 1.34\sigma/h\cdot(\mu U/\sigma)^{2/3} + 12\mu\cdot U\cdot(L1)\cdot\{(G1)/2-h\}/(G1)^3 - 12\mu\cdot h\cdot U\cdot(LS)/D^3 \quad (1)$$

where $P_O$ is an air pressure in a downstream area in said feeding direction of said web from said bead $P_P$ is a pressure of said coating solution in a pocket of said slot die coater, σ is surface tension of said coating solution, μ is a viscosity of said coating solution, U is a coating velocity, h is a wet thickness of a coating formed on said web, $L_S$ is a length of said slot, and D is a distance between surfaces defining said slot, wherein said difference of h is defined as the following formula (2), $$h_{dif} = (h_{max} - h_{min})/h_{ave} \quad (2)$$

where $h_{dif}$ is said difference of h, $h_{max}$ is a maximum of h, $h_{min}$ is a minimum of h, and $h_{ave}$ is an average value of h.

5. A method as claimed in claim 4, wherein said difference between said maximum and said minimum of said first gap $G_1$ in said width direction of said slot die coater is equal to or less than 5 μm.

6. A method as claimed in claim 5, wherein said wet thickness of said coating satisfies 1 μm≦h≦20 μm.

7. A method as claimed in claim 6, wherein said viscosity of said coating solution is equal to or more than 0.5 mPa·s and equal to or less than 100 mPa·s, and said surface tension is equal to or more than 20 mN/m and equal to or less than 70 mN/m.

8. A method as claimed in claim 7, wherein said difference between said maximum and said minimum length of said first gap $G_1$ in said width direction of said slot die coater is determined according to length values of said first gap $G_1$, said length values being measured at plural positions in said width direction of said web along said slot die coater, and the number of said plural position is equal to or more than 10 and equal to or less than 50.

9. A method as claimed in claim 8, wherein said slot die coater is shifted between a coating position for applying said coating solution on said web and a retreat position where a distance from said backup roller is larger than said coating position.

10. A method as claimed in claim 1, a feeding speed of the web is equal to or more than 30 m/min.

11. A method as claimed in claim 1, a feeding speed of the web is equal to or more than 50 m/min.

12. A method as claimed in claim 1, said method further comprising:

producing the film product including the at least one dried coating layer by applying the coating solution on the web using said slot die coater having the slot in which said coating solution flows;

drying the applied coating solution, said web being supported and fed by the back-up roller;

setting said slot die coater to a coating position for discharging said coating solution to said web, said slot discharging mouth of said slot die coater for discharging said coating solution being formed between said first lip and said second lip that are formed of the hard alloy, said first lip being disposed downstream from said second lip in said feeding direction of said web;

measuring a length of a gap $G_1$ at plural positions in a width direction of said web along said slot die coater, said length of said gap $G_1$ being a distance between said first lip of said slot die coater being set in said coating position and said web, and the number of said plural positions being equal to or more than 10 and equal to or less than 50;

adjusting a position of said slot die coater at said coating position such that a difference between a maximum and a minimum of plural measured length values of said gap $G_1$ is equal to or less than 5 μm;

returning said slot die coater to a retreat position where a distance from said back-up roller is larger than said coating position;

starting rotation of said back-up roller to feed said web;

feeding said coating solution to said slot discharging mouth;

setting said slot die coater to said coating position prior to said step of discharging said coating solution from said slot discharging mouth to said web, to form the bead of said coating solution between said slot discharging mouth and said web; and reducing pressure in an upstream area of said feeding direction of said web from said bead than in a downstream area, wherein an amount of said coating solution being discharged and a rotation speed of said back-up roller is determined such that a wet thickness of a coating formed by said coating solution on said web is equal to or more than 1 μm and equal to or less than 20 μm.

13. A method as claimed in claim 12, wherein a distance of said slot is in the range of 100 μm to 500 μm, a length of said slot is in the range of 40 mm to 100 mm, and a difference between a maximum and a minimum values of the length of the gap $G_1$ at the plural positions between said first lip and said web in said width direction of said slot die coater is set such that a difference between a maximum and a minimum of h which is calculated in the following formula (1) as $P_O$-$P_P$ is constant in said width direction is equal to or less than 2% in said width direction of said slot die coater, $$P_O - P_P = 1.34\sigma/h\cdot(\mu U/\sigma)^{2/3} + 12\mu\cdot U\cdot(L1)\cdot\{(G1)/2-h\}/(G1)^3 - 12\mu\cdot h\cdot U\cdot(LS)/D^3 \quad (1)$$

where $P_O$ is an air pressure in a downstream area in said feeding direction of said web from said bead $P_P$ is a pressure of said coating solution in a pocket of said slot die coater, σ is surface tension of said coating solution, μ is a viscosity of said coating solution, U is a coating velocity, h is said wet thickness of said coating formed on said web, $L_S$ is said length of said slot, and D is said distance between surfaces defining said slot.

14. A method as claimed in claim 12, further comprising:

measuring a difference between the maximum value of the length of said gap $G_1$ and the minimum value of the length of the gap $G_1$ at the plural positions;

obtaining a range of said gap $G_1$ such that a difference of h, which is calculated in the following formula (1) as $P_O$-$P_P$ is constant in said width direction of said slot die coater, is equal to or less than 2%; and setting the gap $G_1$ to a value equal to or more than said range of said gap $G_1$, $$P_O P_P = 1.34\sigma/h\cdot(\mu U/\sigma)^{2/3} + 12\mu\cdot U\cdot(L1)\cdot\{(G1)/2-h\}/(G1)^3 - 12\mu\cdot h\cdot U\cdot(LS)/D^3 \quad (1)$$

where $P_O$ is an air pressure in a downstream area in said feeding direction of said web from said bead $P_P$ is a pressure of said coating solution in a pocket of said slot die coater, σ is surface tension of said coating solution, μ is a viscosity of said coating solution, U is a coating velocity, h is said wet thickness of said coating formed on said web, $L_S$ is a length of said slot, and D is a distance between surfaces defining said slot, wherein said difference of h is defined as the following formula (2), $$h_{dif} = (h_{max} - h_{min})/h_{ave} \quad (2)$$

where $h_{dif}$ is said difference of h, $h_{max}$ is a maximum of h, $h_{min}$ is a minimum of h, and $h_{ave}$ is an average value of h.

15. A method as claimed in claim 1, said method further comprising:

producing the film product including the at least one dried coating layer by applying the coating solution on the web using said slot die coater having the slot in which said coating solution flows;

drying the applied coating solution, said web being supported and fed by the back-up roller;

setting said slot die coater to a coating position for discharging said coating solution to said web, said slot discharging mouth of said slot die coater for discharging said coating solution being formed between said first lip and said second lip that are formed of the hard alloy, said first lip being disposed downstream from said second lip in said feeding direction of said web;

measuring a length of a gap $G_1$ at plural positions in a width direction of said web along said slot die coater, said gap $G_1$ being a distance between said first lip of said slot die coater being set in said coating position and said web, and the number of said plural positions being equal to or more than 10 and equal to or less than 50;

adjusting a position of said slot die coater at said coating position such that a difference between a maximum and a minimum of plural measured length values of said gap $G_1$ is equal to or less than 5 μm;

returning said slot die coater to a retreat position where a distance from said back-up roller is larger than said coating position;

feeding said coating solution to said slot discharging mouth;

disposing a vacuum chamber in an upstream area in said feeding direction of said web from said slot discharging mouth of said slot die coater, said vacuum chamber comprising an opening facing a feeding path of said web, side plates having cutouts substantially in an arc along a periphery of said back-up roller and a back plate extending in a width direction of said web, for dividing a decompression area in an upstream side in said feeding direction of said web;

starting rotation of said back-up roller to feed said web;

setting said slot die coater to said coating position;

performing said step of discharging said coating solution from said slot discharging mouth to said web, to form the bead of said coating solution between said slot discharging mouth and said web; and reducing pressure in the upstream area of said feeding direction of said web from said bead than in a downstream area by said vacuum chamber, wherein each of a gap $G_B$ between said back plate and said web and a gap $G_s$ between said side plates and said web is larger than said gap $G_1$, and equal to or more than 100 μm and equal to or less than 500 μm, and wherein an amount of said coating solution being discharged and a rotation speed of said back-up roller is determined such that a wet thickness of a coating formed by said coating solution on said web is equal to or more than 1 μm and equal to or less than 20 μm.

* * * * *